US007551879B2

(12) United States Patent
Kosuge

(10) Patent No.: US 7,551,879 B2
(45) Date of Patent: Jun. 23, 2009

(54) CHARGING DEVICE, PROCESS UNIT, IMAGE FORMING APPARATUS, AND METHOD FOR PRODUCING ROTATING MEMBER

(75) Inventor: Akio Kosuge, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 228 days.

(21) Appl. No.: 11/242,782

(22) Filed: Oct. 5, 2005

(65) Prior Publication Data

US 2006/0078353 A1 Apr. 13, 2006

(30) Foreign Application Priority Data

Oct. 8, 2004 (JP) ..... 2004-296032
Oct. 8, 2004 (JP) ..... 2004-296036

(51) Int. Cl.
*G03G 15/02* (2006.01)

(52) U.S. Cl. ..... 399/176; 361/221; 492/39

(58) Field of Classification Search ..... 399/176; 361/221; 492/39
See application file for complete search history.

(56) References Cited

U.S. PATENT DOCUMENTS 5,701,551 A * 12/1997 Honda et al. ..... 399/50
5,974,281 A * 10/1999 Fujii et al. ..... 399/66
6,541,172 B2 * 4/2003 Nagasaka et al. ..... 430/59.5
6,807,390 B2 10/2004 Suda et al.
2002/0051654 A1 * 5/2002 Niimi et al. ..... 399/159
2004/0109706 A1 6/2004 Kosuge et al.
2005/0185989 A1 8/2005 Kosuge et al.

FOREIGN PATENT DOCUMENTS

JP 2001-194868 7/2001
JP 2002-55508 2/2002

OTHER PUBLICATIONS

U.S. Appl. No. 11/769,066, filed Jun. 27, 2007, Kosuge.
U.S. Appl. No. 11/857,070, filed Sep. 18, 2007, Kosuge.
U.S. Appl. No. 11/935,106, filed Nov. 5, 2007, Muraishi, et al.
U.S. Appl. No. 12/099,496, filed Apr. 8, 2008, Yoshino, et al.
U.S. Appl. No. 12/134,701, filed Jun. 6, 2008, Kosuge, et al.

* cited by examiner

*Primary Examiner*—David M. Gray
*Assistant Examiner*—Bryan Ready
(74) *Attorney, Agent, or Firm*—Oblon, Spivak, McClelland, Maier & Neustadt, P.C.

(57) ABSTRACT

An image forming apparatus has a latent image supporting body configured by a substrate and a covering layer provided on the substrate; and a charging device which is a rotating body configured by an axis member and a charging member provided on the axis member, and which charges the latent image supporting body facing the charging member. In this image forming apparatus, a value, which is obtained by dividing a capacitance [pF] between the axis member in the rotating body and the substrate in the latent image supporting body by the length [mm] in the direction perpendicular to the direction of the surface migration of the charging member, is set to be at least 0.35 [pF/mm], the capacitance being obtained when, instead of the latent image supporting body, the substrate in the latent image supporting body is caused to face the charging member.

5 Claims, 7 Drawing Sheets

| TYPE OF CHARGING ROLLER | MATERIAL OF DISCHARGING MEMBER | CHARGING GAP [μm] | CAPACITANCE C1 [pF] | C1/L [pF/mm] | CHARGING IRREGULARITY |
|---|---|---|---|---|---|
| A | ABS | 0 | 385 | 1.26 | ○ |
| B | ABS | 23 | 234 | 0.79 | ○ |
| C | ABS | 45 | 136 | 0.45 | ○ |
| D | ABS | 67 | 103 | 0.35 | ○ |
| E | ABS | 85 | 83 | 0.27 | × |
| F | PVDF | 0 | 460 | 1.51 | ○ |
| G | PVDF | 45 | 94 | 0.31 | × |

FIG. 7

| TYPE OF CHARGING ROLLER | MATERIAL OF DISCHARGING MEMBER | CHARGING GAP [μm] | CAPACITANCE C1 [pF] | C1/L [pF/mm] | CHARGING IRREGULARITY |
|---|---|---|---|---|---|
| A | ABS | 0 | 385 | 1.26 | ○ |
| B | ABS | 23 | 234 | 0.79 | ○ |
| C | ABS | 45 | 136 | 0.45 | ○ |
| D | ABS | 67 | 103 | 0.35 | ○ |
| E | ABS | 85 | 83 | 0.27 | × |
| F | PVDF | 0 | 460 | 1.51 | ○ |
| G | PVDF | 45 | 94 | 0.31 | × |

FIG. 8

| CHARGING GAP [μm] | | CHARGING IRREGULARITY OF PHOTOCONDUCTOR | TONER STAIN OF DISCHARGING MEMBER |
|---|---|---|---|
| MAXIMUM VALUE | MINIMUM VALUE | | |
| 36 | 8 | ○ | × |
| 44 | 15 | ○ | ○ |
| 61 | 29 | ○ | ○ |
| 75 | 42 | ○ | ○ |
| 82 | 50 | × | EXPERIMENT WAS NOT PERFORMED |

FIG. 9

| TYPE OF ROLLER | ABUTTING ROLLER | | DISCHARGING ROLLER | | FLUCTUATION OF CHARGING GAP | DAMAGE OF PHOTOCONDUCTOR SURFACE |
|---|---|---|---|---|---|---|
| | MATERIAL | DEGREE OF HARDNESS | MATERIAL | DEGREE OF HARDNESS | | |
| A | | 33 | ABS | 63 | × | ◎ |
| B | EEA | 44 | ABS | 63 | ○ | ◎ |
| C | HDPE | 58 | ABS | 63 | ○ | ○ |
| D | PP | 69 | ABS | 63 | ○ | △ |
| E | POM | 75 | ABS | 63 | ○ | × |
| F | ABS | 82 | ABS | 63 | ○ | × |
| G | | 33 | EEA | 44 | × | ◎ |
| H | EEA | 44 | EEA | 44 | ○ | ○ |
| I | HDPE | 58 | EEA | 44 | ○ | △ |
| J | POM | 75 | EEA | 44 | ○ | × |
| K | | 33 | | 33 | × | ○ |
| L | HDPE | 58 | | 33 | × | △ |
| M | ABS | 82 | | 33 | × | × |

CHARGING DEVICE, PROCESS UNIT, IMAGE FORMING APPARATUS, AND METHOD FOR PRODUCING ROTATING MEMBER

BACKGROUND OF THE INVENTION

1. Field of the Invention

The present invention relates to an image forming apparatus such as a copying machine, facsimile device and a printer, a charging device and a process unit which are installed in such devices. Moreover, the present invention relates to a rotating member production method for producing a rotating member installed in a charging device.

2. Description of the Background Art

There has been conventionally well-known an image forming apparatus in which after forming a latent image through writing with light onto a latent image supporting body which is subjected to charging evenly by a charging device, a toner as an image forming substance attached to the latent image to obtain a visible image. Furthermore, as a charging device installed in the above type of image forming apparatus, there has been known a contact roller type charging device for subjecting a latent image supporting body to charging evenly by bringing a charging roller applied with a charging bias into a contact the latent image supporting body while rotating the charging roller. There has been also known a non-contact roller type charging device for subjecting a latent image supporting body to charging evenly through discharge from a discharging portion such as a conductive rubber, while keeping a predetermined charge gap between the discharging portion and latent image supporting body in the charging roller. In comparison with the contact roller type charging device, the non-contact roller type charging device can stably maintain the charging performance, since it is difficult to fix the toner to the roller surface due to less transition of the toner from the latent image supporting body to the charging roller. For such a non-contact roller type charging device, the one described in, for example, Japanese Patent Application Laid-Open No. 2001-194868 and Japanese Patent Application Laid-Open No. 2002-55508 is known.

In the non-contact roller type charging device described in abovementioned Japanese Patent Application Laid-Open No. 2001-194868, there is used a charging roller, which is obtained by fixing a conductive rubber to a surface of a cored bar, and winding a film member with a thickness of approximately 100 [μm] around each end portion of the conductive rubber in the direction of a roller axis line. By abutting the film members on both end portions onto a drum-like photoconductor, which is a latent image supporting body, a gap of approximately 100 [μm] is kept between the photoconductor and a discharging portion which is a section on the conductive rubber, around which the film member is not wound. In such a charging roller, if the degree of hardness of the conductive rubber is reduced as the environmental temperature increases, the degree to which the film member is embedded in the conductive rubber increases, the film rubber being pressure-welded to the photoconductor. Therefore, the above-described charge gap is reduced. On the other hand, if the degree of hardness of the conductive rubber is increased as the environmental temperature decreases, the degree to which the film member is embedded in the conductive rubber decreases, thus the charge gap becomes larger. As a result, the discharging portion is brought too close to the photoconductor when the temperature becomes relatively high, whereby the toner is easily fixed to the discharging portion, or the discharging portion is brought too far from the photoconductor when the temperature becomes relatively low, thereby causing charge irregularity in the photoconductor.

In order to reduce such toner adhesion and charge irregularity, the present applicants have experimentally produced a charging roller in which is used, as a material for a discharging portion, a conductive rigid plastic instead of a flexible conductive robber. However, in this charging roller, a film member with a thickness of approximately 50 [μm], which is used as an abutting member to be abutted onto a photoconductor, falls off the surface of the discharging portion, which is made of the rigid plastic, due to friction with the photoconductor. For this reason, this charging roller could not provide durability to be able to respond to actual use.

In order to resolve such a defect related to durability, the charging roller which is proposed in abovementioned Japanese Patent Application Laid-Open No. 2002-55508 is a charging roller in which a concave portion extending in the direction of the roller circumference is provided on each end portion in the direction of a roller axis line in a discharging portion, and a heat shrinkable tube is thermally shrunk within the concave portions so that it slightly protrudes from upper ends of the concave portions, and is abutted onto a photoconductor. In this configuration, by embedding the heat shrinkable tube in the concave portions and fixing it firmly to the discharging portion, the tube as an abutting member can be prevented from falling off, and preferable durability to be able to respond to actual use can be achieved.

However, in this charging roller, thickness deviation in the tube periphery after the tube is shrunk is large, thus a charge gap per rotation of the charging roller fluctuates significantly. In relatively high environmental temperature, when a thin part of the tube was abutted onto the photoconductor, the charge gap became extremely small, and the toner was fixed easily to the discharging portion. Moreover, in relatively low environmental temperature, when a thick part of the tube was abutted onto the photoconductor, the charge gap became extremely large, which has caused failure in charging.

The present applicants therefore are in the process of developing a charging roller having a new configuration as follows. Specifically, the present applicants are in the process of developing a charging roller in which a cored bar as an axis member is coated with a discharging member composed of a conductive material, ring-like abutting members having a diameter larger than that of the discharging member are fixed on both end portions in the direction of the axis line of the axis member such that the discharging member is placed between these abutting members. In this configuration, the abutting members are not fixed to a relatively flexible discharging portion, which is made of a conductive rubber, but to a highly rigid axis member. For this reason, it is possible to avoid a situation in which the abutting members are embedded significantly in the discharging portion which became too flexible in high environmental temperature, and fluctuation of the charge gap which is caused by such penetration of the abutting members can be resolved. Moreover, the thick abutting members which are not deformed easily can be fixed firmly to the axis member by means of press-fitting, bonding, and laminating methods. Therefore, instead of obtaining an abutting member by attaching a thin film, which is deformed easily, to the discharging member and operating it as the abutting member, reduction of durability due to peeling of the abutting members can be prevented. Further, as the abutting members, it is possible to use the one such as rigid plastic formed into the shape of a ring, which is made of material in which thickness deviation can be adjusted more easily than the heat shrinkable tube. Therefore, toner adhesion and charge irregularity caused by the change in temperature and thickness deviation of the abutting members can also be prevented.

However, it has been discovered that, in such a charging roller as well, according to the material of the charging member or abutting member to be selected, fluctuation of the charge gap is caused by the change in temperature, thereby causing toner adhesion or charge irregularity.

As described above, in a conventional non-contact roller type, according to the set value of the charge gap or the material of the discharging portion of the charging roller, it was difficult to subject the latent image supporting body to charging evenly, causing charge irregularity.

SUMMARY OF THE INVENTION

It is an object of the present invention to provide a charging device, process unit, image forming apparatus, and a method for producing a rotating member, in which a discharging portion migrating on a surface is caused to face a latent image supporting body with a predetermined gap, and charge irregularity caused when the latent image supporting body is subjected to charging can be prevented by discharge from the discharging portion.

It is other object of the present invention to provide a charging device, process unit, image forming apparatus, and a method for producing a rotating member, which can effectively prevent toner adhesion to the discharging member caused by fluctuation of the gap and charge irregularity, while preventing reduction of durability caused by the abutting members falling off.

In an aspect of the present invention, an image forming apparatus comprises a latent image supporting body comprising a substrate and a covering layer provided on the substrate; and a charging device which is a rotating body comprising an axis member and a charging member provided on the axis member, and which charges the latent image supporting body facing the charging member. A value, which is obtained by dividing a capacitance [pF] between the axis member in the rotating body and the substrate in the latent image supporting body by the length [mm] in the direction perpendicular to the direction of the surface migration of the charging member, is at least 0.35 [pF/mm]. The capacitance is obtained when, instead of the latent image supporting body, the substrate in the latent image supporting body is caused to face the charging member.

In another aspect of the present invention, a rotating member production method produces a rotating member in a charging device which has the rotating member in which abutting members abutting onto a latent image supporting body and a discharging member facing the latent image supporting body with a predetermined gap and for discharging toward the latent image supporting body are fixed to a rotatable axis member throughout the entire circumference in the direction of rotation of the axis member. The latent image supporting body is charged by discharge from the discharging member, while keeping the gap between the latent image supporting body and the discharging member by means of the latent image supporting body and abutting members abutting on to each other. The method comprises the steps of fixing the discharging member to the axis member, fixing the abutting members to both end portions or the vicinity of the end portions of the axis member in the direction of the axis line, to dispose the discharging member between the abutting members and subjecting the discharging member and the abutting members to a lathe turning process to adjust the diameters thereof.

In another aspect of the present invention, a process unit is provided in which at least a latent image supporting body and a charging device of an image forming apparatus are detachably supported by the image forming apparatus main body as one unit. The latent image supporting body comprises a substrate and a covering layer provided on the substrate. The charging device is a rotating body comprising an axis member and a charging member provided on the axis member, and charges the latent image supporting body facing the charging member. Furthermore a value, which is obtained by dividing a capacitance [pF] between the axis member in the rotating body and the substrate in the latent image supporting body by the length [mm] in the direction perpendicular to the direction of the surface migration of the charging member, is at least 0.35 [pF/mm]. The capacitance is obtained when, instead of the latent image supporting body, the substrate in the latent image supporting body is caused to face the charging member.

In another aspect of the present invention, a charging device which is a rotating body comprising abutting members abutting onto a charged body, an axis member, and a charging member provided on the axis member. A space between the charged body and the charging member is formed by causing the abutting members to abut onto the charged member, to charge the charged body. The abutting members has a degree of hardness (JIS D) of at least 44 degrees are used. The charging member has a degree of hardness (JIS D) of at least 44 degrees is used. The space under an environment where ambient temperature is between 10 and 32 [° C.] is set between 15 through 75 [μm].

In another aspect of the present invention, a rotating member production method produces a rotating member in a charging device which has the rotating member in which abutting members abutting onto a charged body and a discharging member facing the charged body via a space and for discharging toward the charged body are fixed to a rotatable axis member throughout the entire circumference in the direction of rotation of the axis member. The charged body is charged by discharge from the discharging member, while keeping the space between the charged body and the discharging member by means of the charged body and abutting members abutting onto each other. The method comprises the steps of using the abutting members having a degree of hardness (JIS D) of at least 44 degrees, and the discharging member having a degree of hardness (JIS D) of at least 44 degrees, to fix the discharging member to the axis member; fixing the abutting members to both end portions or the vicinity of the end portions of the axis member in the direction of the axis line so as to dispose the discharging member fixed to the axis member between the abutting members; and subjecting the discharging member and the abutting members to a lathe turning process to adjust the diameters thereof.

In another aspect of the present invention, a process unit has a charging device. The charging device is a rotating body comprising abutting members abutting onto a charged body, an axis member, and a charging member provided on the axis member. A space between the charged body and the charging member is formed by causing the abutting members to abut onto the charged member, to charge the charged body. The abutting members has a degree of hardness (JIS D) of at least 44 degrees are used. The charging member has a degree of hardness (JIS D) of at least 44 degrees is used. The space under an environment where ambient temperature is between 10 and 32 [° C.] is set between 15 through 75 [μm].

In an aspect of the present invention, an image forming apparatus has a charged body charged by a charging device. The charging device is a rotating body comprising abutting members abutting onto a charged body, an axis member, and a charging member provided on the axis member. A space between the charged body and the charging member is formed by causing the abutting members to abut onto the charged member, to charge the charged body. The abutting members has a degree of hardness (JIS D) of at least 44 degrees are used. The charging member has a degree of hardness (JIS D) of at least 44 degrees is used. The space under an environment where ambient temperature is between 10 and 32 [° C.] is set between 15 through 75 [μm].

In another aspect of the present invention, a charging device is provided with a rotating body comprising abutting members abutting onto a charged body, an axis member, and a charging member provided on the axis member. A space between the charged body and the charging member is formed by causing the abutting members to abut onto the charged member, to charge the charged body. The abutting members has a degree of hardness (JIS D) of at least 44 degrees are used. The charging member has a degree of hardness (JIS D) of at least 44 degrees is used. A fluctuation width of the space per rotation of the rotating body is 40 [μm] or less under an environment where ambient temperature is between 10 and 32 [° C.].

In another aspect of the present invention, a process unit has a charging device. The charging device is a rotating body comprising abutting members abutting onto a charged body, an axis member, and a charging member provided on the axis member. A space between the charged body and the charging member is formed by causing the abutting members to abut onto the charged member, to charge the charged body. The abutting members having a degree of hardness (JIS D) of at least 44 degrees are used. The charging member has a degree of hardness (JIS D) of at least 44 degrees is used. A fluctuation width of the space per rotation of the rotating body is 40 [μm] or less under an environment where ambient temperature is between 10 and 32 [° C.].

In another aspect of the present invention, an image forming apparatus has a charged body charged by a charging device. The charging device is a rotating body comprising abutting members abutting onto a charged body, an axis member, and a charging member provided on the axis member. A space between the charged body and the charging member is formed by causing the abutting members to abut onto the charged member, to charge the charged body. The abutting members has a degree of hardness (JIS D) of at least 44 degrees are used. The charging member has a degree of hardness (JIS D) of at least 44 degrees is used. A fluctuation width of the space per rotation of the rotating body is 40 [μm] or less under an environment where ambient temperature is between 10 and 32 [° C.].

BRIEF DESCRIPTION OF THE DRAWINGS

The above and other objects, features and advantages of the present invention will become more apparent from the following detailed description taken with the accompanying drawings in which:

FIG. 7 is a table showing an experimental result related to charge irregularity;

FIG. 8 is a table showing an experimental result related to charge irregularity and toner stain of the discharging member;

FIG. 9 is a table showing an experimental result related to fluctuation of the charge gap;

DESCRIPTION OF THE PREFERRED EMBODIMENT(S)

Each of the embodiments of the present invention is described in detail hereinafter with reference to the figures.

First Embodiment

First, the applicants have found that, when a metallic body having the same metallic material, size and shape as a metallic base body of a latent image supporting body is caused, instead of the latent image supporting body, to face a discharging member with a predetermined charge gap, by setting a material, size, shape and the like of the charge gap and of the latent image supporting body, and by setting the charge gap so that the following condition is satisfied, charge irregularity of the latent image supporting body can be prevented. Specifically, the condition is that a value obtained by dividing a capacitance [pF] between an axis member in a rotating member installed in a charging device and the abovementioned metallic body, by the length [mm] of the discharging member in the direction perpendicular to the direction of the surface migration of discharging member is at least 0.35 [pF/mm]. Therefore, in this first embodiment, the discharging portion which migrates on a surface is caused to face the latent image supporting body with a predetermined gap, and, at the same time, charge irregularity, which is caused when the latent image supporting body is subjected to charging by discharge from the discharging portion, can be prevented.

Hereinafter the first embodiment is described in detail.

First, as an image forming apparatus related to the present embodiment, an electrophotographic type color laser printer (simply called "printer" hereinafter) is described.

Figure 1:
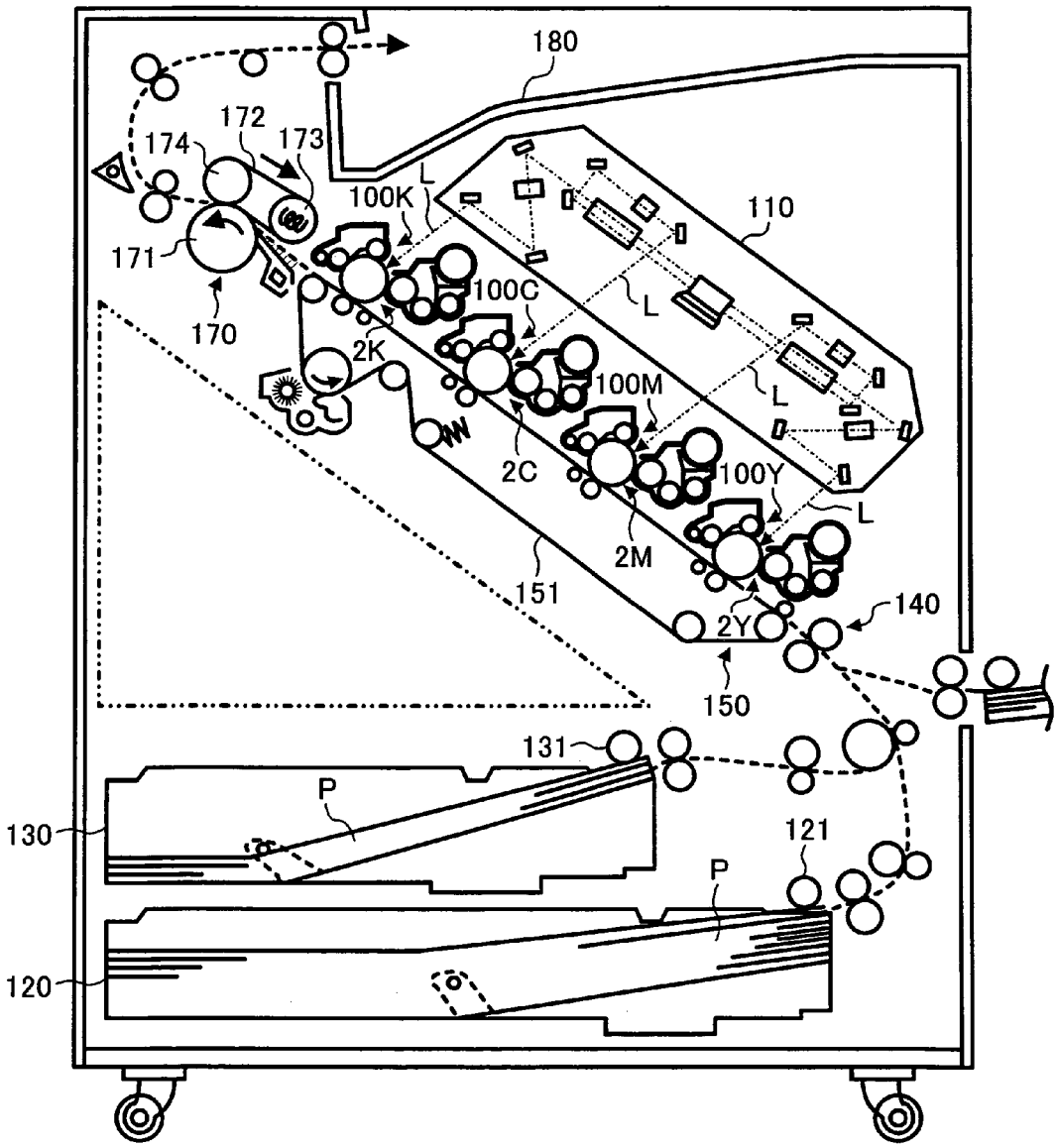
FIG. 1 is a figure showing a schematic configuration of a printer related to each embodiment of the present invention.

FIG. 1 shows a schematic configuration of this printer. As shown in the figure, this printer comprises four toner image forming portions 100Y, 100M, 100C and 100K for forming an image of each color of yellow (Y), magenta (M), cyan (C), and black (K). The printer further comprises a light writing unit 110, paper cassettes 120 and 130, a pair of resist rollers 140, transcription device 150, belt fixing type fixing device 170, stack portion 180, and the like. Moreover, the printer comprises a toner replenishment container, toner dispensing bottle, power unit, and the like. It should be noted that the symbols, Y, M, C, and K indicate respective members for the colors, yellow, magenta, cyan an black.

The light writing unit 110 has a light source consisted by four laser diodes corresponding to each of the colors Y, M, C, and K, polygon mirror with regular hexahedron, a polygon motor for rotary driving the polygon mirror, fθ lens, lens, reflective mirror, and the like. Laser light L emitted from the laser diodes is reflected by any one of the surfaces of the polygon mirror, and reaches a photoconductor surface while being caused to be deflected as the polygon mirror rotates. Then, the photoconductor surface is subjected to light scanning in the direction of the axis line.

The toner image forming portions 100Y, 100M, 100C and 100K have drum-like photoconductors 2Y, 2M, 2C and 2K as image supporting bodies. These photoconductors 2Y, 2M, 2C and 2K are drums having a diameter of 30 [mm] in which a base pipe made of aluminum or the like is coated with an organic photosensitive layer, and are rotary driven in clockwise direction in the figure at a linear velocity of 125 [mm/sec] by driving means which is not shown. The photoconductors are subjected to light scanning in the dark by means of the abovementioned light writing unit 110 which emits the laser light L modulated based on image information sent from an unshown personal computer or the like, and supports an electrostatic latent images for Y, M, C and K.

Figure 2:
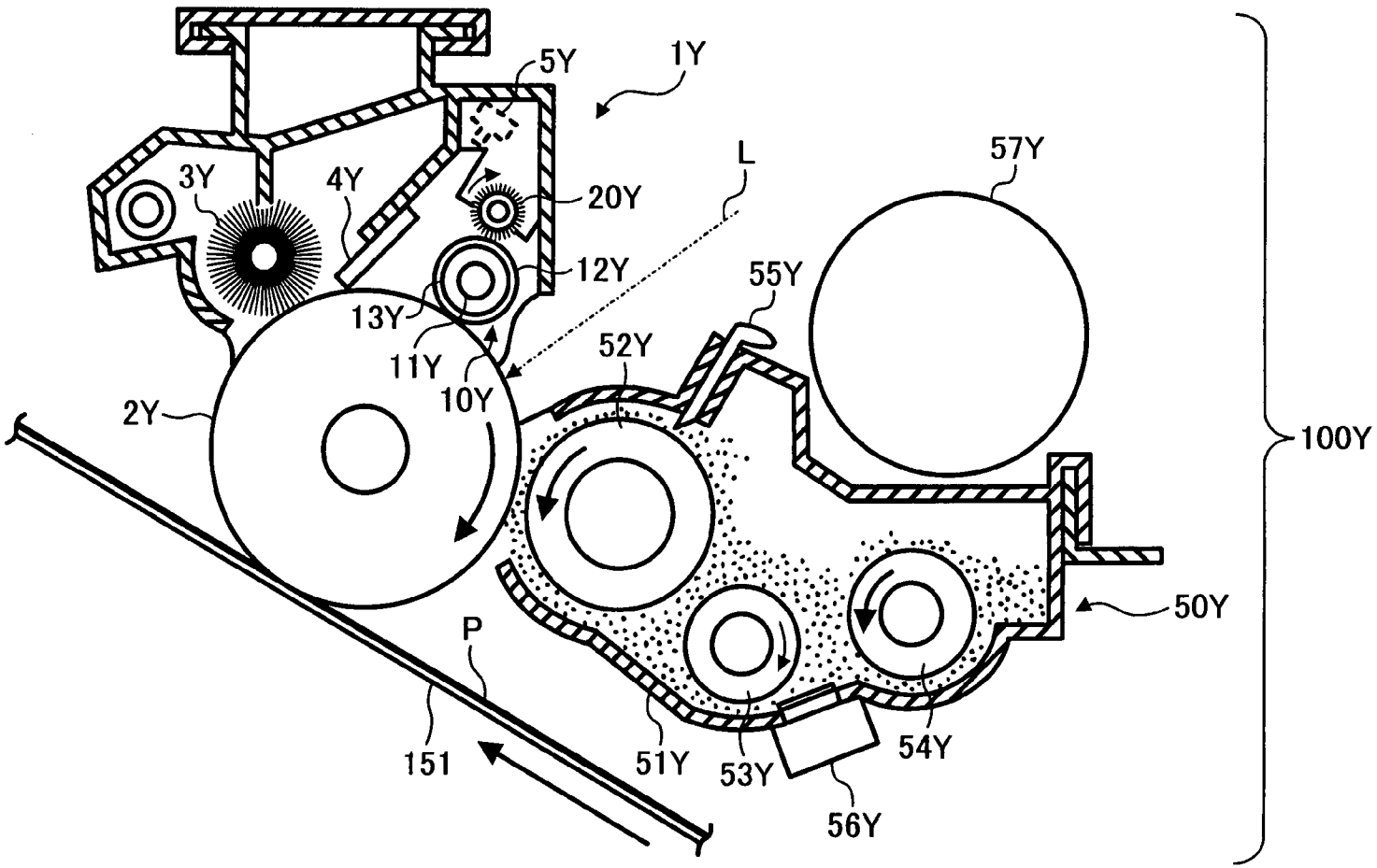
FIG. 2 is a figure showing a configuration of a part of a toner image forming portion for Y in the printer and a transcription device.

FIG. 2 is an enlarged configuration diagram showing the toner image forming portion 100Y for Y of the four toner image forming portions 100Y, 100M, 100C and 100K, along with the transcription device 150. It should be noted that the rest of the toner image forming portions (100M, 100C, and 100K) have the same configuration as the toner image forming portion for Y except that the toner colors to be used are different, thus explanations for these portions are omitted. In the same figure, the toner image forming portion 100Y comprises a process unit 1Y and a development device 50Y. The process unit 1Y has, in addition to a photoconductor 2Y, a brush roller 3Y for applying a lubricant on the surface of the photoconductor 2Y, a slidable counter blade 4Y for performing cleaning processing, an antistatic lamp 5Y for performing electricity removal processing. The process unit 1Y further has a charging roller 10Y for uniformly charging the photoconductor 2Y, a roller cleaning device 20Y for cleaning a surface of the charging roller 10Y, and the like.

In the process unit 1Y, the charging roller 10Y which is applied with an alternating charging bias by an unshown power source is constituted by an axis member 11Y, abutting roller 12Y, discharging member 13Y, and the like. The axis member 11Y is a cored bar of the charging roller 10Y, both end portions of which are supported rotatably by a bearing which is not shown. The axis member 11Y is applied with a charging bias in which an AC bias is superimposed on a DC bias by the power source which is not shown. A central portion surface in the direction of the axis line in the axis member 11Y is covered with the discharging member 13Y covered with a conductive material, throughout the entire circumference in the direction of the axis circumference. The ring-like abutting roller 12Y made of an insulating material is fixed in the vicinity of each end of the axis member 11Y by means of press fitting and bonding so as to interpose the charging roller member 13Y therebetween. The external diameter of the abutting roller 12Y is larger than the external diameter of the discharging member 13Y by several tens through 100 [μm]. The charging roller 10Y causes the discharging member 13Y to face the photoconductor 2Y with a predetermined charge gap therebetween while abutting the abutting roller 12Y to the photoconductor 2Y. The charging roller 10Y then causes the surface of the photoconductor 2Y to be charged uniformly by means of discharge from the discharging member 13Y, while being rotated by unshown driving means such that its surface is moved in a direction opposite of the direction of surface migration of the photoconductor 2Y. when the laser light L which is modulated and deflected by the abovementioned light writing unit (reference numeral 110 in FIG. 1) is scanned on the surface of the photoconductor 2Y which is charged uniformly as above, an electrostatic latent image is formed on the surface.

The development device 50Y has a development roll 52Y exposing apart of the circumferential surface thereof from an opening provided in a casing 51Y. The development device 50Y further has a first conveyance screw 53Y, second conveyance screw 54Y, development doctor 55Y, toner density sensor (called "T sensor" hereinafter) 56Y, communication portion 57Y communicating with an unshown powder pump, and the like.

The casing 51Y accommodates therein a Y developer having a magnetic carrier and minus electrostatic Y toner. After being frictionally charged while being stirred and conveyed by the first conveyance screw 53Y and second conveyance screw 54Y, the Y developer is supported by the surface of the developing roll 52Y which is a developer supporting body. The Y developer is then controlled at its layer thickness by the development doctor 55Y, and then conveyed to a development region to face the photoconductor 2Y. Then, Y toner is attached to the electrostatic latent image on the photoconductor 2Y in this region. A Y toner image is formed on the photoconductor 2Y through this attachment. After spending the Y toner in this development, the Y developer is returned to the inside the casing 51Y as the surface of the development roll 52Y (development sleeve) rotates. On the other hand, the Y toner image which has made a contribution to the development is transferred to transfer paper P which is conveyed by the paper conveyance belt 151. It should be noted that the development roll 52Y has the development sleeve which is rotary driven by the unshown driving means and is composed of a nonmagnetic pipe, and an unshown magnet roller accommodated so that it is not involved in rotation of the development sleeve. The Y developer is drawn to the surface of the development sleeve by magnetic force of the magnet roller, and then supported.

The T sensor 56Y is attached to a base plate of the casing 51Y, and outputs voltage of the value corresponding to the magnetic permeability of the Y developer conveyed by the first conveyance screw 53Y. The magnetic permeability of the developer indicates a favorable correlation with the toner density of the developer, thus the T sensor 56Y outputs voltage of the value corresponding to the Y toner density. The value the output voltage is sent to a control unit which is not shown. This control unit comprises storage means such as RAM in which are stored data of Vtref for Y, which is a target value of the output voltage sent from the T sensor 56Y, and of Vtref for M, C and K which are target values of output voltages sent from a T sensor installed in other development device. In the development device 50Y for Y, the value of the output voltage sent from the T sensor 56Y is compared with the Y Vtref, and the unshown powder pump connected to a Y toner cartridge is driven for a period of time corresponding to the comparison result. Accordingly, the Y toner inside the Y toner cartridge is replenished in the development device 50Y via the communication portion 57Y. By controlling the drive of the powder pump as above (toner replenishment control), an appropriate amount of Y toner is replenished in the Y developer in which the Y toner density of the developer is lowered with the development, and the Y toner density of the developer inside the development device 50Y is kept under a predetermined range. It should be noted that the same toner replenishment control is implemented in other development device as well.

In this manner as described above, each of the toner image forming portions 100Y, 100M, 100C and 100K shown in FIG. 1 earlier works together with the light writing unit 110 to form a visible toner image on each of the photoconductors 2Y, 2M, 2C and 2K. Therefore, in the present printer, the combination of the toner image forming portions 100Y, 100M, 100C and 100K and the light writing unit 110 functions as visible image forming means for forming a toner image on surfaces of the photoconductors 2Y, 2M, 2C and 2K that endlessly move.

Each color of the toners Y, M, C and K has a binding resin, coloring agent, and charge control agent as the main components, and other addition agent is added according to need. As the binding agent, polystyrene, styrene-acrylate copolymer, polyester resin, or the like can be used.

As the coloring agent (for example, yellow, magenta, cyan and black), the one which has been conventionally known can be used. It is appropriate that the amount of the coloring agent be 0.1 through 1.5 wt % with respect to 100 wt % of the binding resin.

As the charge control agent, a nigrosin stain, chromium-containing complex, quaternized ammonium salt, or the like, and these are used appropriately according to the polarity of toner particle. The loading of the charge control agent is 0.1 through 10 wt % with respect to 100 wt % of the binding resin.

It is preferred that a toner particle be added with a fluidity additive. As the fluidity additive, metallic oxide fine particles such as silica, titania, alumina and the like, and a substance obtained by surface-treating these fine particles by means of a silane coupling agent, titanate coupling agent and the like, or polymer fine particles such as polystyrene, poly methyl methacrylate, polyvinylidene difluoride and the like can be used. The particle diameter of such fluidity additive is preferably between 0.01 and 3 μm. It is preferred that the loading of the fluidity additive be between 0.1 and 7.0 wt % with respect to 100 wt % of the toner particle.

As a method for producing the toners, various known methods or a combination of these methods can be used. For example, in a kneading and grinding method, first a binding resin, coloring agent (for example, carbon black), and other necessary addition agent are subjected to dry blending, and thus obtained substance is subjected to heating, melting and kneading by means of an extruder, twin roll, triple roll and the like. Then, thus obtained substance is cooled and solidified, and ground by a crushing machine such as a jet mill, and thereafter a toner is obtained by an air sifter. Moreover, a toner can be produced from a monomer, coloring agent, addition agent and the like by means of a suspension polymerization method or nonaqueous dispersion polymerization method.

As the carrier of the developer, generally the one composed of a core or the one in which the core is provided with a covering layer is used. As the core of a resin coating carrier, ferrite, magnetite or the like having a particle diameter of approximately 20 through 60 μm can be used. Moreover, the examples of the material for the covering layer on the core are polyvinylidene fluoride, tetrafluoroethylene, hexafluoropropylene, perfluoroalkyl vinyl ether, fluorine atom-substituted vinyl ether, fluorine atom-substituted vinyl ketone, and the like. Examples of a method for forming the covering layer include a method for applying a resin on the surface of a core particle by means of an atomization method, dipping method, and the like.

The two paper cassettes 120 and 130 are arranged in a lower section of the printer main body. These paper cassettes 120 and 130 accommodate a pile of a plurality of stacked transfer papers P, and feed rollers 121 and 131 are pressed against the top transfer paper P. The feed rollers 121 and 131 are rotated at a predetermined timing, and the transfer papers P are sent to a feed path. The pair of resist rollers 140 are disposed at an end of the feed path, which send the transfer paper P, which has been sent, to the transcription device 150, which is described hereinafter, at a timing of synchronization with the Y toner image formed on the photoconductor 2Y of the Y toner image forming portion 100Y.

Figure 3:
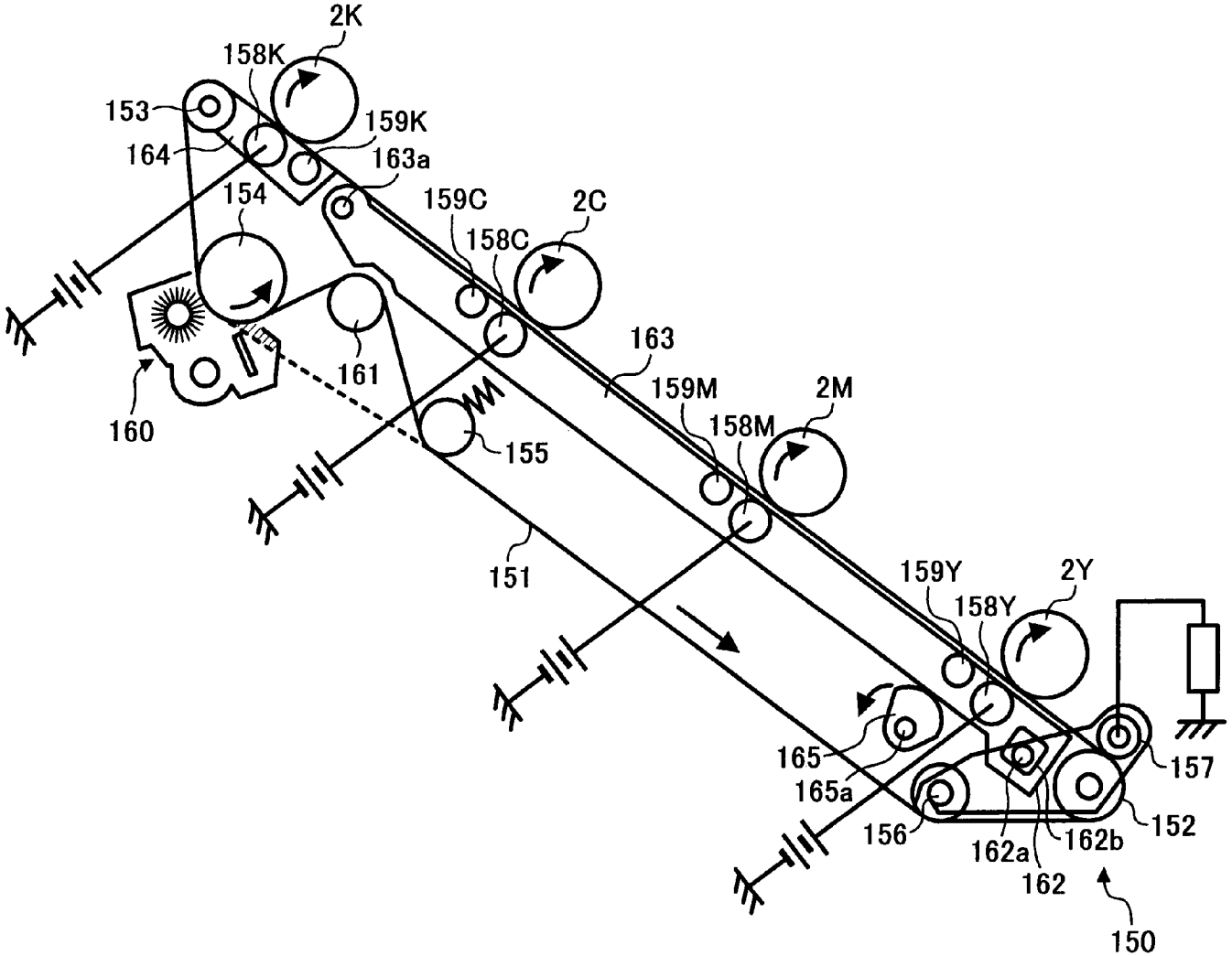
FIG. 3 is a figure showing a substantial configuration of the transcription device.

FIG. 3 is an enlarged configuration diagram showing a substantial configuration of the transcription device 150. In this figure, the transcription device 150 has a belt device having the conveyance belt 151 and a plurality of extension belts. The extension belts installed in the belt device are, specifically, five rollers of an entry roller 152, separation roller 153, drive roller 154, tension roller 155, and lower roller 156. In addition to the belt device having such configuration, the transcription device 150 further has an electrostatic attraction roller 157, four transfer bias rollers 158Y, 158M, 158C and 158K, four conveyance support rollers 159Y, 159M, 159C and 59K, belt cleaning device 160, pressing roller 161, and the like. The transcription device 150 further has an entry bracket 162, swing bracket 163, exit bracket 164, cam 165, and the like.

The paper conveyance belt 151 is a high-resistance endless single layer belt in which the electrical resistivity is adjusted to $10^{10}$ through $10^{12}$ [Ωcm] and the surface resistivity is adjusted to $10^{12}$ through $10^{14}$ [Ω/□], and PVDF (polyvinylidene difluoride) is used as its material. The paper conveyance belt 151 is caused to endlessly moved in anticlockwise direction in the figure by the drive roller 154 that is rotary driven in anticlockwise direction in the figure by the unshown driving means, while being extended by the plurality of extension rollers. It should be noted that, instead of polyvinylidene difluoride, polyimide, polycarbonate, polyethylene terephthalate, or the like can be used as the material of the paper conveyance belt 151. Moreover, by taking these resins as base layers, surface layers may be formed by means of a spraying or dipping method to obtain a multi-layered belt.

The entry roller 152, transfer bias rollers 158Y, 158M, 158C and 158K, conveyance support rollers 159Y, 159M, 159C and 159K, separation roller 153, drive roller 154, tension roller 155, and lower roller 156 contact the back face of the paper conveyance belt 151. Of these rollers, the entry roller 152, which is disposed at the rightmost part in the figure, is disposed such that the paper conveyance belt 151 is interposed between the entry roller 152 and the electrostatic attraction roller 157 disposed nearby. The electrostatic attraction roller 157 electrostatically attracts the transfer paper P, which is sent from the pair of resist rollers (140) described hereinafter, by applying the electrical charge to the front face of the belt by means of an electrostatic attraction bias applied from the power source which is not shown.

The four transfer bias rollers 158Y, 158M, 158C and 158K are the rollers in which the metallic cored bars are covered with an elastic body such as a sponge. They are pressed against the photoconductors 2Y, 2M, 2C and 2K, and disposed so as to have the paper conveyance belt 151 therebetween. By pressing them, four transfer nips for Y, M, C and K where the photoconductors 2Y, 2M, 2C and 2K and the paper conveyance belt 151 contact with each other in a predetermined length in the belt movement direction are formed. Further, the cored bars of the transfer bias rollers 158Y, 158M, 158C and 158K are applied with transfer biases that are subjected to constant current control by transfer bias power sources respectively. Accordingly, transfer charge is applied to the back face of the paper conveyance belt 151 via the transfer bias rollers 158Y, 158M, 158C and 158K, and a transfer electrical field is formed between the paper conveyance belt 151 and the photoconductors 2Y, 2M, 2C and 2K in the respective transfer nips. It should be noted that the present printer is provided with the transfer bias rollers 158Y, 158M, 158C and 158K as the transcription means, but may have a brush, blade, or the like, instead of the rollers. The printer may further have a transfer charger or the like.

Of the four transfer bias rollers 158Y, 158M, 158C and 158K, Y, M and C are respectively supported by the swing bracket 163 via bearing members which are not shown. The swing bracket 163 is disposed inside the loop of the paper conveyance belt 151, and is configured so as to be swingable around a rotation axis 162*a*. Of the four conveyance support rollers 159Y, 159M, 159C and 159K, Y, M and C are supported by the swing bracket 163. The cam 165, which is driven by being rotated around a rotation axis 165*a* by the unshown driving means, is disposed in the lower section of the swing bracket 163 in the figure. If the rotation of it is stopped at a position where a cam surface is abutted onto the swing bracket 163, the swing bracket 163 is caused to swing around a rotation axis 163*a* in anticlockwise direction in the figure. The transfer bias rollers 158Y, 158M and 158C for Y, M and C are caused to abut against the photoconductors 2Y, 2M and 2C via the paper conveyance belt 151, whereby transfer nips for Y, M and C are formed. On the other hand, if the rotation of the cam 165 is stopped at a position where the cam surface is not abutted onto the swing bracket 163, the swing bracket 163 is caused to swing around the rotation axis 163*a* in clockwise direction in the figure. Then, the transfer bias rollers 158Y, 158M and 158C for Y, M and C move to a position where the paper conveyance belt 151 is not pressed against the photoconductor 2Y, 2M and 2C, whereby the Y, M, C transfer nips are not formed. In this manner, the transcription device 150 causes the paper conveyance belt 151 to abut against the photoconductors 2Y, 2M and 2C by means of the swing bracket 163 to form Y, M and C transfer nips, and causes the paper conveyance belt 151 to separate from the photoconductors 2Y, 2M and 2C.

The entry roller 152, electrostatic attraction roller 157, and lower roller 156 are respectively supported by the entry bracket 162 via bearing members which are not shown. The entry bracket 162 is disposed inside the loop of the paper conveyance belt 151, and is configured so as to be swingable around an axis of the lower roller 156.

The swing bracket 163 has a guide hole 163*b* in the vicinity of its left end in the figure, and a pin 162*a* which extends from the entry bracket 162 is placed so as to be able to swing in side the guide hole. When the swing bracket 163 is swung in anticlockwise direction in the figure by rotation of the cam 165, the pin 162*a* inside the guide hole 162*b* is lifted up. Then, the entry bracket 162 links to the swing motion of the swing bracket 163, is caused to swing around the axis of the lower roller 156 in anticlockwise direction in the figure, and lifts up the entry roller 152, electrostatic attraction roller 157, and lower roller 156. When the swing bracket 163 is swung in clockwise direction in the figure, the entry bracket 162 links to the swing motion of the swing bracket 163, is caused to swing in clockwise direction in the figure, and moves the entry roller 152, electrostatic attraction roller 157, and lower roller 156 downward. By the entry roller 152, electrostatic attraction roller 157, and lower roller 156 being moved with such swing motions of the swing bracket 163, paper conveying surfaces from the paper conveyance belt 151 are maintained linearly.

The transcription device 150 causes the swing bracket 163 to swing in clockwise direction in the figure when transferring a plain black toner image onto the transfer paper P, and causes the paper conveyance belt 151 to separate from the photoconductors 2Y, 2M and 2C for Y, M and C. Toner image transcription is not performed in the Y, M and C transfer nips when transferring a plain black toner image, thus the transcription of the plain black toner image is performed without forming these transfer nips. Therefore, a plain black toner image can be transferred without causing an extra burden on the paper conveyance belt 151 or its drive system.

Of the four transfer bias rollers 158Y, 158M, 158C and 158K, the transfer bias roller 158K for K is supported by the exit bracket 164 via a bearing member which is not shown. The exit bracket 164 is disposed inside the loop of the paper conveyance belt 151, and is configured so as to be swingable around an axis of the exit roller 165. Of the four conveyance support rollers 159Y, 159M, 159C and 159K, the conveyance support roller 159K for K is also supported by the exit bracket 164. The transfer bias roller 158K for K moves to a position where the paper conveyance belt 151 is not pressed against the photoconductor 2K for K by a clockwise swing motion of the exit bracket 164 in the figure. In this state if the swing bracket 163 is caused to swing in a clockwise direction in the figure, the paper conveyance belt 151 is separated from all the photoconductors 2Y, 2M, 2C and 2K. The transcription device 150 is attached to or detached from the printer main body in such a state where the paper conveyance belt 151 is separated from all of the photoconductors.

The transcription device 150 causes the paper conveyance belt 151 to contact all the photoconductors 2Y, 2M, 2C and 2K when transferring a full-color image, which is described hereinafter, onto the transfer paper P, and forms the transfer nips for Y, M, C and K. The transfer paper P, which is sent from the after-mentioned pair of resist rollers (140), is interposed between the abovementioned electrostatic attraction roller 157 and the paper conveyance belt 151. The transfer paper P then passes through the transfer nips for Y, M, C and K sequentially while being attracted to the front face of the paper conveyance belt 151. Accordingly, the Y, M, C and K toner images on the respective photoconductors 2Y, 2M, 2C and 2K are superimposed on the transfer paper P respectively in the transfer nips, are then subjected to the actions of the abovementioned transfer electrical field and nip pressure, and transferred onto the transfer paper P in a superimposed fashion. A full-color image is then formed on the transfer paper P by this transcription in the superimposed fashion.

The transfer paper P on which a full-color image is formed reaches a belt extension position of the separation roller 153 as the paper conveyance belt 151 moves endlessly. In this belt extension position, the separation roller 153 winds around the paper conveyance belt 151 at a sharp winding angle such that the direction of endless movement of the paper conveyance belt 151 is reversed. The transfer paper P attracted to the paper conveyance belt 151 cannot follow such a sudden change of the moving direction of the belt, and is caused to separate from the paper conveyance belt 151. The transfer paper P is then transferred to a fixing device which is not shown.

The tension roller 155 is biased toward the paper conveyance belt 151 by a spring, and thereby applies predetermined tension to the paper conveyance belt 151. The pressing roller 161 is pressed against a front face of an opened/stretched section of the belt between the tension roller 155 and the drive roller 154. By this pressing, the paper conveyance belt 151 curves toward the inside of the loop. Because of such large curve of the paper conveyance belt 151, even larger winding section of the paper conveyance belt 151 with respect to the drive roller 154 is secured. The belt cleaning device 160 abuts against the front face of this winding section. Toner stain which has spread from the photoconductors 2Y, 2M, 2C and 2K adheres to the front face of the paper conveyance belt 151 which transferred the transfer paper P to the fixing device at the extension position of the separation roller 153. The belt cleaning device 160 is to remove such toner stain from the paper conveyance belt 151.

In the FIG. 1 which is described above, the fixing device 170 has a pressure roller 171, fixing belt 172, heating roller 173, drive roller 174, and the like. The fixing belt 172 is caused to endlessly moved in clockwise direction in the figure by the drive roller 174 that is rotary driven by the unshown driving means, while being extended by the heating roller 173 and drive roller 174. The heating roller 173 as heating means accommodates therein a heat source such as a halogen lamp, and heats the fixing belt 172 from its back face by means of this heat source. On the other hand, the pressure roller 171 as an abutting roller rotates such that it is caused to move on the surface at a contact portion in the same way as the belt, while contacting the fixing belt 172 which is caused to make endless movement, and forms fixing nips. The transfer paper P which has been transferred from the paper conveyance belt 151 of the transcription device 150 to the fixing device 170 is interposed between the fixing nips such that the image transfer face of the paper is brought into contact with the fixing belt 172. The transfer paper then passes through the fixing device 170 as a full-color image is fixed to the image transfer face by the heat and pressure.

The transfer paper P which has passed through the fixing device 170 then passes through a pair of conveyance rollers, reverse guide plate and then a pair of conveyance rollers, and is discharged toward the stack portion 180 provided on the upper surface of a printer's chassis.

In FIG. 2 described above, the surface of the photoconductor 2Y after Y transfer nip is passed is applied with a predetermined amount of a lubricant by the brush roller 3Y as lubricant applying means, which is rotary driven in anticlockwise direction in the figure, and, thereafter, subjected to cleaning by the counter blade 4Y. The electricity on the surface is removed by light emitted from the antistatic lamp 5Y, and formation of the next electrostatic latent image is prepared.

The discharging member 13Y of the charging roller 10Y is in a noncontact state with respect to the photoconductor 2Y, but sometimes the toner of the photoconductor 2Y is adhered to the discharging member by electrostatic force. The adhered toner is subjected to cleaning electrostatically from the surface of the discharging member 13Y by the roller cleaning device 20Y which rotates while contacting the discharging member 13Y.

It should be noted in the figure that a charging device that charges the photoconductor 2Y, which is a charged body, by means of the charging roller 10Y or roller cleaning device 20Y is configured. Furthermore, the process unit 11Y is supported by a common support medium such that the photoconductor 2Y, charging device, brush roller 3Y, counter blade 4Y, antistatic lamp 5Y, and the like are detachable as one unit with respect to the printer main body. Y toner image forming portion 100Y of the four toner image forming portions 100Y, 100M, 100C and 100K is described above, and descriptions for the rest of the toner image forming portions 100M, 100C and 100K are omitted since they all have the same configuration as the Y toner image forming portion.

Next, a characteristic configuration of the present printer is described.

Figure 4:
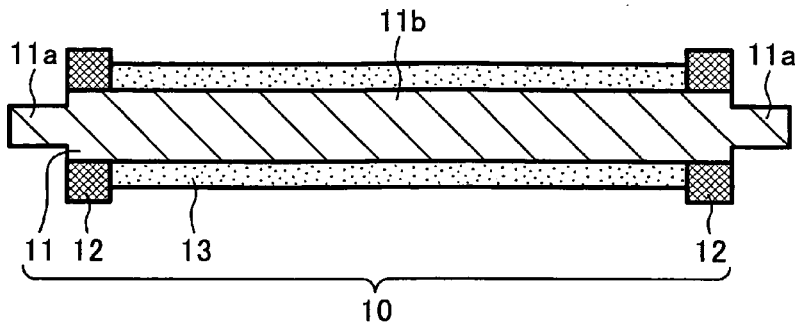
FIG. 4 is a vertical cross-sectional view showing a configuration o a charging roller of the printer.

FIG. 4 is a vertical cross-sectional view of the charging roller of the present printer. It should be noted that the toner image forming portions for the respective colors of Y, M, C and K have the same configuration as the toner image forming portion for Y except that the corresponding toner colors are different, thus additional characters of Y, M, C and K provided at the end of the reference symbols are omitted in the figures following FIG. 4. In FIG. 4, a charging roller 10 as a rotating member has an axis member 11, two abutting rollers 12, and a discharging member 13 that are made from metal such as stainless. The axis member 11 is constituted by a cylindrical main axis portion 11*b*, and protruding axis portions 11*a* that protrude from both ends, in the direction of the axis line, of the main axis portion 11*b*. The diameter of the main axis portion 11*b* is 8 [mm]. The discharging member 13 is obtained by forming a conductive resin to have a thickness of 1.5 [mm] throughout the entire circumference of the main axis portion 11*b* by means of an injection molding process with respect to a central portion in the direction of the axis line of the main axis portion 11*b* of the axis member 11. The external diameter of the discharging member is approximately 11 [mm]. The two abutting rollers 12 as abutting members have an external diameter of approximately 11.1 [mm], an internal diameter of lower 8 [mm], and are made of a ring-like insulating rigid plastic with a length in the direction of the axis line of 8 [mm]. The abutting rollers 12 are fixed to both end portions of the main axis portion 11*b* by press fitting and bonding so as to have the discharging member 13 fixed to the axis member 11 therebetween.

Figure 5:
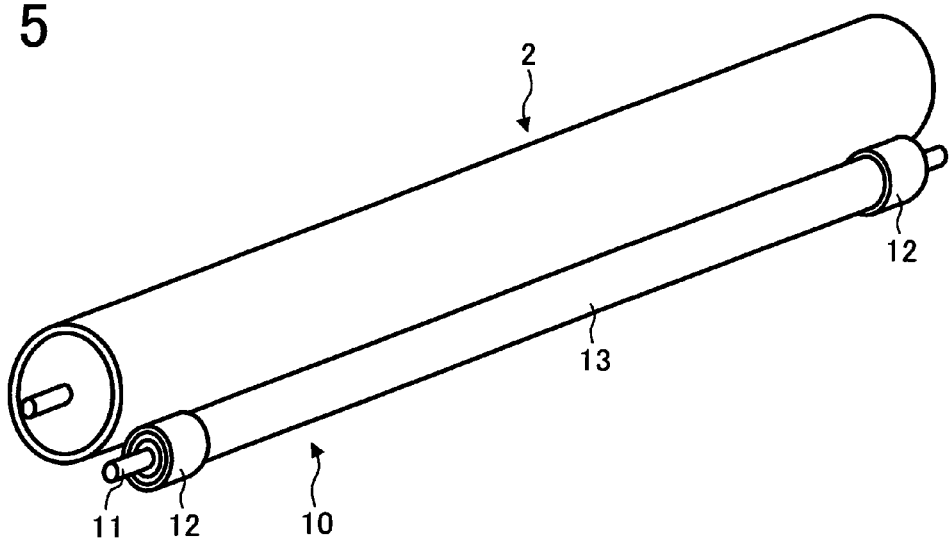
FIG. 5 is a perspective view showing an exterior of a photoconductor and the charging roller of the printer.

FIG. 5 is a perspective view showing the photoconductor and the charging roller of the present printer. In the figure, the axis member 11 of the charging roller 10 is biased toward the drum-like photoconductor 2 by an unshown spring which abuts against an unshown bearing, and at the same time the protruding axis portions (11*a*) at the both ends of the axis member are supported rotatably by the bearing. By this biasing, the two abutting rollers 12 of the charging roller 10 abut against the vicinity of the both ends of the photoconductor 2, and a charge gap of several tens through 100 [μm] is formed between the discharging member 13 and the surface of the photoconductor 2. Of the two protruding axis portions (11*a*) in the axis member 11, one is attached with an unshown drive receiving gear, which engages with an unshown flange gear attached to the axis of the photoconductor 2, whereby the charging roller 10 rotates. In this rotation, the charging roller 10 is synchronized with the photoconductor 2 and driven, thus, even if a friction coefficient of the abutting rollers 12 is reduced, the charging roller 10 can rotate securely without causing it to slip.

Incidentally, in the charging device described in above-mentioned Japanese Patent Application Laid-Open No. 2001-194868, there is used a charging roller, which is obtained by fixing a conductive rubber to a surface of a cored bar, and winding a film member with a thickness of approximately 100 [μm] around each end portion of the conductive rubber in the direction of a roller axis line. By abutting the film members on both end portions onto a drum-like photoconductor, which is a latent image supporting body, a gap of approximately 100 [μm] is kept between the photoconductor and a discharging portion which is a section on the conductive rubber, around which the film member is not wound. In such a charging roller, if the degree of hardness of the conductive rubber is reduced as the environmental temperature increases, the degree to which the film member is embedded in the conductive rubber increases, the film rubber being pressure-welded to the photoconductor. Therefore, the above-described charge gap is reduced. On the other hand, if the degree of hardness of the conductive rubber is increased as the environmental temperature decreases, the degree to which the film member is embedded in the conductive rubber decreases, thus the charge gap becomes larger. As a result, the discharging portion is brought too close to the photoconductor when the temperature becomes relatively low, whereby the toner is easily fixed to the discharging portion, or the discharging portion is brought too far from the photoconductor when the temperature becomes relatively high, thereby causing charge irregularity in the photoconductor.

In order to reduce such toner adhesion and charge irregularity, the present applicants have experimentally produced a charging roller in which is used, as a material for a discharging portion, a conductive rigid plastic instead of a flexible conductive robber. However, in this charging roller, a film member with a thickness of approximately 100 [μm], which is used as an abutting member to be abutted onto a photoconductor, falls off the surface of the discharging portion, which is made of the rigid plastic, due to friction with the photoconductor. For this reason, this charging roller could not provide durability to be able to respond to actual use.

In order to resolve such a defect related to durability, the present applicants have proposed a charging roller as follows, in abovementioned Japanese Patent Application Laid-Open No. 2002-55508. Specifically, it is a charging roller in which a concave portion extending in the direction of the roller circumference is provided on each end portion in the direction of a roller axis line in a discharging portion, and a heat shrinkable tube is thermally shrunk within the concave portions so that it slightly protrudes from upper ends of the concave portions, and is abutted onto a photoconductor. In this configuration, by embedding the heat shrinkable tube in the concave portions and fixing it firmly to the discharging portion, the tube as an abutting member can be prevented from falling off, and preferable durability to be able to respond to actual use can be achieved.

However, in this charging roller, thickness deviation in the tube periphery after the tube is shrunk is large, thus a charge gap per rotation of the charging rope fluctuates significantly. In relatively low environmental temperature, when a thin part of the tube was abutted onto the photoconductor, the charge gap became extremely small, and the toner was fixed easily to the discharging portion. Moreover, in relatively high environmental temperature, when a thick part of the tube was abutted onto the photoconductor, the charge gap became extremely large, which has caused failure in charging.

Therefore, the present applicants have developed a charging roller 10 as shown in FIG. 4 and FIG. 5, in which the main axis portion 11*b* of the axis member 11 is coated with the discharging member 13 composed of a conductive material, ring-like abutting members 12 having a diameter larger than that of the discharging member 13 are fixed on both end portions of the main axis portion 11*b* such that the discharging member 13 is placed between these abutting members. In the charging roller 10 having such a configuration, the abutting members 12 are not fixed to a relatively flexible substrate, which is made of a conductive rubber, but to a highly rigid axis member 11. For this reason, it is possible to avoid a situation in which the abutting members 12 are embedded significantly in the substrate which became too flexible in high environmental temperature, and fluctuation of the charge gap which is caused by such penetration of the abutting members can be resolved. Moreover, the abutting members 12 which are thicker than the discharging member 13 can be fixed firmly to the axis member 11 by means of press-fitting, bonding, and laminating methods, thus reduction of durability due to peeling of the abutting members 12 can be prevented. Further, as the abutting members 12, it is possible to use the one such as rigid plastic formed into the shape of a ring, which is made of material in which thickness deviation can be adjusted more easily than the heat shrinkable tube. Therefore, toner adhesion and charge irregularity caused by the change in temperature and thickness deviation of the abutting members 12 can also be prevented.

However, not only in the charging roller 10, but also in a non-contact type charging device which causes the photoconductor 2 to be charged by discharge from a facing portion facing the photoconductor 2 with a predetermined charge gap, following problems have occurred. Specifically, regardless of temperature fluctuation, according to the set value of the charge gap or the material of the discharging portion of the charging roller, it was difficult to subject the photoconductor 2 to charging evenly, causing charge irregularity. The present applicants therefore have performed experiments which are described hereinafter.

First, as the charging roller 10, seven types of charging rollers indicated with A through G are experimentally produced, these charging rollers being described hereinafter. It should be noted that, of these seven types of charging rollers 10, A through E are produced as follows. Specifically, first of all, a resin composition, which is obtained by compounding a 60 wt % of ion conductive agent composed of a polyolefin polymer compound having a quaternary ammonium base into a 100 wt % of a base resin, was injection molded to have a thickness of several [mm] throughout the entire circumference of the central portion of the main axis portion 11*b*, which is made from stainless and has a diameter of 9 [mm]. Accordingly, the discharging member 13 made of a thermoplastic resin was fixed to the central portion of the main axis portion 11*b*. Next, the ring-like abutting roller 12, which is obtained by molding a thermoplastic resin to have an inner diameter of low 9 [mm], an external diameter of dozen [mm], and a length of 8 [mm] in the direction of the axis line, was press fitted and bonded to each end portion of the main axis portion 11*b*. Then, thus obtained roller was subjected to precise molding by a lathe turning and cutting machine. Specifically, by means of a lathe turning and cutting process, the discharging member 13 was subjected to cutting to obtain a diameter of 11 [mm], and at the same time the abutting rollers 12 were subjected to a cutting to obtain a diameter which is slightly larger than 11 [mm]. In this manner, by fixing both discharging member 13 and abutting rollers 12 to the main axis portion 11*b*, and thereafter subjecting them to cutting to finish their diameters, gap fluctuation in the circumferential direction of the charging roller 10, which is caused by the eccentricity at the time of lathe turning and cutting, can be resolved. Specifically, the lathe turning and cutting machine cannot finish a cutting article to obtain a perfect circle. The reason is that it is inevitable that the workpiece is rotated in a slightly eccentric state due to limited form accuracy in a chuck holding the workpiece. Supposed that the discharging member 13 fixed to the main axis portion 11*b* is processed and finished by means of the lathe turning and cutting process that generates such slight eccentricity, and at the same time the abutting rollers 12 are fixed to the main axis portion 11*b* after being finished by means of lathe turning. As a result, the eccentricity phase of the discharging member 13 and the eccentricity phase of the abutting rollers 12 deviate in the circumferential direction of the charging roller 10, thereby causing gap fluctuation in the circumferential direction. On the other hand, if the both are fixed to the main axis portion 11*b*, and thereafter the diameters are finished by means of the lathe turning and cutting process, the eccentricity phase of both can be made uniform, thus gap fluctuation caused by the eccentricity at the time of lathe turning and cutting can be resolved.

[Charging Roller A]

A resin composition (volume resistivity of $10^5$ Ωcm), which is obtained by compounding a 60 wt % of ion conductive agent into a 100 wt % of an ABS resin (acrylonitrile butadiene styrene copolymer), was injection molded to have a thickness of several [mm] throughout the entire circumference of the central portion of the main axis portion 11*b*, whereby the discharging member 13 was obtained. The ring-like abutting roller 12 was fixed to each end portion of the main axis portion 11*b* by means of press fitting and boding, and then is connected to the discharged member 13, and thereafter the discharging member 13 was finished to obtain an external diameter of 11 [mm] by means of a lathe turning and cutting process. The abutting rollers 12 were also finished to obtain an external diameter of 11 [mm]. In the charging roller 10 of such a configuration, no steps exist in the thickness direction of the discharging member 13 and abutting rollers 12, thus a contact roller type charging roller in which a charge gap is not formed is obtained.

[Charging Roller B]

A charging roller 10 was created in the same way as the charging roller A, except that the external diameter of the abutting roller 12 was made approximately 11.03 [mm] by means of the lathe turning and cutting process.

[Charging Roller C]

A charging roller 10 was created in the same way as the charging roller A, except that the external diameter of the abutting roller 12 was made approximately 11.05 [mm] by means of the lathe turning and cutting process.

[Charging Roller D]

A charging roller 10 was created in the same way as the charging roller A, except that the external diameter of the abutting roller 12 was made approximately 11.07 [mm] by means of the lathe turning and cutting process.

[Charging Roller E]

A charging roller 10 was created in the same way as the charging roller A, except that the external diameter of the abutting roller 12 was made approximately 11.09 [mm] by means of the lathe turning and cutting process.

[Charging Roller F]

A conductive resin tube having a thickness of 150 [μm] was fixed. The conductive resin tube of 150 [μm] in thickness and $10^6$ [Ωcm] in volume resistivity in which carbon is dispersed in a 100 wt % of a PVDF resin (polyvinylidene difluoride-polyvinylidene fluoroethylene) is fixed to the main axis portion 11*b* of the axis member 11 having an external diameter of approximately 10.85 [mm] and made of stainless. Accordingly, a charging roller in which the external diameter of the discharging member 13 is 11 [mm] and which does not have the abutting members was obtained. This charging roller of such a configuration is also of contact type in which the discharging member 13 contacts the photoconductor 2.

[Charging Roller G]

A resin tape which is made of a PET resin layer and adhesive layer and has a thickness of 50 [μm] is attached to each end portion of the discharging member 13 in the direction of the axis line in the charging roller F so as to be abutted onto the photoconductor 2.

The length of any of these charging rollers A through G corresponds to the width direction of A3 paper, and the photoconductor 2 can be charged at a charge width of 305 [mm]. It should be noted that the photoconductor 2 is obtained by coating a surface of a drum-like aluminum base pipe (metallic substrate) having a 30 [mm] diameter with a photosensitive layer or the like.

Figure 6:
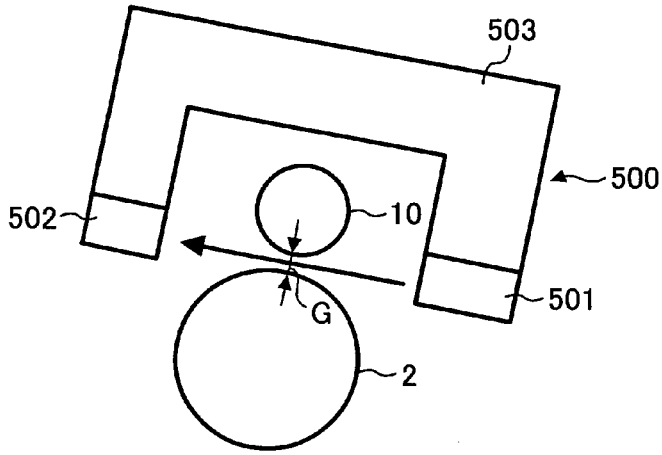
FIG. 6 is a frame format showing a gap measuring device along with the photoconductor and the charging roller.

Next, these charging rollers A through G were sequentially replaced with a charging roller of a process unit (1K) in IPSiO Color 8100 converter produced by Ricoh Company, Ltd., to measure a charge gap. The charge gap can be measured using a gap measuring device shown in FIG. 6. This gap measuring device 500 is set to the process unit such that laser light emitted from a laser light emitting portion 501 is received by a light receiving portion 502 through a charge gap G. A value of the charge gap G can be obtained based on the amount of light received by the light receiving portion 502. A hold portion 503 which holds the laser light emitting portion 501 and light receiving portion 502 is supported so as to be able to make a slide movement on an unshown guide rail, along the direction of the depth of the figure, that is, the direction of the axis line of the photoconductor 2. By causing the hold portion 503 to make a slide movement by means of unshown driving means, a charge gap can be sequentially measured in the direction of the axis line of the photoconductor 2. For the gap measuring device 500 of such a configuration, Laser Scan Micrometer LSM-600 produced by Mitutoyo Corporation was used.

Next, instead of the photoconductor (2K), an aluminum drum (diameter is 30 mm) having the same metallic material, shape and size as the aluminum base pipe of the photoconductor is set in the process unit (1K) in the abovementioned converter. The charging roller of the process unit (1K) is replaced with the abovementioned charging rollers A through G sequentially, and at the same time the capacitance between the metallic drum and discharging member (13) is measured. This measurement is performed using LCR Meter 4263B produced by HP. At this moment, measured voltage was set to 1V and measured frequency was set to 1 kHz, and the lead wire of the LCR Meter was connected to the axis member (11) of the charging roller and the earth electrode making slide friction with the metallic drum.

Next, the aluminum drum of the process unit (1K) in the abovementioned converter was removed, and the photoconductor (2K) was set again. The photoconductor (2K) is obtained by coating a surface of the aluminum base pipe having a 30 [mm] diameter with an under layer with a 3 [μm] thickness, a charge generation layer with a 0.15 [μm] thickness, a charge transport layer with a 20 [μm] thickness, and a surface protection layer with a 5 [μm] thickness sequentially. The surface protection layer was formed by means of spray coating. The rest of the layers were formed by means of dip coating. Polycarbonate is used as a binder resin for the charge transport layer and the surface protection layer, and alumina particles with an average diameter of 0.3 [μm] are added to the surface protection layer at a rate of 15 wt % with respect to the total solid. When measuring the thickness of each layer, FISCHERSCOPE MMS produced by FISCHER, which is an eddy current-type film thickness meter, was used.

The abovementioned converter was operated to print out a test image, while replacing the charging roller of the process unit (1K) in which the photoconductor (2K) as described is set, with the above-described charging rollers A through G. A printout paper was viewed through a microscope to examine whether density irregularity caused by charging irregularity of the photoconductor (2K) appears on the test image or not.

FIG. 7 shows a result of the experiment described above. It should be noted that the charge gap in FIG. 7 is an average value per rotation of the charging roller when the aluminum drum was set. Moreover, "o" in the section of "charging irregularity" indicates that generation of density irregularity due to charging irregularity was not found. "X" indicates that generation of density irregularity due to charging irregularity was found. C1/L is a value obtained by dividing a measurement value of capacitance C1 measured by the abovementioned LCR meter, by the charge width L (305 [mm]) of the charging roller. The charge width L indicates the length of the discharging member 13 in the direction of the roller axis line, in the A through F charging rollers. Further, in the G charging roller, the charge width L is a value obtained by subtracting the length of a resin tape attachment region from the length of the discharging member 13 in the direction of the roller axis line.

As shown in FIG. 7, charging irregularity has occurred when the charging rollers E and G were used, but charging irregularity has not occurred when other charging rollers were used. Since charging irregularity did not occur in other rollers having the discharging members (13) of the same electrical resistivity as that of the discharging member (13) of the charging rollers E and G, it can be considered that there is no linkage between generation of charging irregularity and the electrical resistivity of the discharging member (13). A fact that is common to the charging roller E and the charging roller G can be that C1/L for both is in a relatively small value. If the C1/L and a generation status of charging irregularity are focused, it can be considered that having a condition that C1/L is at least 0.35 is the condition for controlling a generation of charging irregularity. Therefore, in the present printer the charging roller with such a condition is used as the charging roller 10.

It should be noted that, as the photoconductor (2K) o the process unit (1K) which implements a printout operation for evaluating a generation of charging irregularity, printout was performed using photoconductors which are coated with charge transport layers of thicknesses of 25, 30, and 35 [μm] instead of a charge transport layer of a thickness of 20 [μm]. However, when using any of the photoconductors (2K), the same result was found in the A through G charging rollers. Therefore, as long as the covering layer has a thickness of 28.15 (3+0.15+20+5) μm through 43.15 (3+0.15+35+5) μm, based on a result of the measurement of the capacitance C1 in which is used the aluminum drum with no such covering layer, it is allowed to evaluate whether or not the result is the condition for controlling charging irregularity.

Next, the present applicant have experimentally produced, as the charging roller 10 shown in FIG. 5, a plurality of types of charging rollers in which the charging gaps between the discharging members 13 and photoconductors 2 are different. An experiment was performed such that a reference image is output to examine the charging gap, the degree of stain of the discharging member 13, and the charge state o the photoconductor 2, while sequentially replacing these charging rollers with respect to the present printer. IPSiO Color 8100 converter produced by Ricoh Company, Ltd. was used as the printer, and the process linear velocity was set to 125 [mm]. As the charging bias, a charging bias in which an AC bias of 900 [Hz] frequency is superimposed on a −700 [V] DC bias was used. For the peak-to-peak voltage of the AC bias, the initial state is set to 1.8 [kV]. Then, the abovementioned converter was used to output a halftone reference image. When density irregularity in the form of black and white dots due to charging irregularity in the photoconductor 2 is generated in the output image, the peak-to-peak voltage of the AC bias is set to be larger, and thereafter a reference image is output again to check the presence of density irregularity. If density irregularity occurs even after setting the peak-to-peak voltage to 2.8 [kV] or greater, it was judged that charging irregularity of the photoconductor 2 due to the fact that the charging gap exceeded the tolerance level was generated (X in FIG. 8 described herein after). Even when density irregularity did not occur, the reference image was output continuously to the plurality of transfer papers, and when the density irregularity occurred in the middle of output, further output was performed while gradually increasing the peak-to-peak voltage. If density irregularity did not occur after all even when outputting to the 50,000 papers, it was judged that charging irregularity of the photoconductor 2 due to the fact that the charging gap exceeded the tolerance level was not generated (o in FIG. 8 described hereinafter). Regarding the degree of stain of the discharging members 13, the presence of density irregularity in the form of vertical lines caused by the stain of the discharging members 13 was checked respectively, while continuously outputting the reference image to the plurality of transfer papers. If the presence was not confirmed even when outputting to the 50,000 papers, it was evaluated that there was no stain (o in FIG. 8 described hereinafter). Furthermore, if the presence was confirmed when outputting to the 50,000 papers or less, it was evaluated that there was stain (X in FIG. 8 described hereinafter).

A result of the experiment was as shown in FIG. 8. It should be noted that this experiment was carried out under an environment where ambient temperatures was 20 [° C.] and humidity was 50 [%]. Also, regarding the charging gap, the one on both end portions in the direction of the charging roller axis line and the one in the central portion were measured. FIG. 8 shows the maximum values and minimum values of these measurement values.

According to the result shown in FIG. 8, it is clear that the degree of stain by the toner starts to worsen drastically, when the charging gap, which is a space between the discharging member 13 and photoconductor 12, is below 15 μm. Therefore, regarding the charging gap, it can be said that if it is not kept to at least 15 μm under an environment where ambient temperature is between 10 and 32° C. regardless of a change in temperature, deterioration or decrease in life of the charging performance due to the toner stain in the discharging member 13 can easily occur.

Moreover, according to the result shown in FIG. 8, it is clear that, if the charging gap exceeds 75 μm, charging irregularity of the photoconductor 2 due to generation of abnormal discharge starts worsen drastically because the charging gap has exceeded the tolerance level. Therefore, regarding the charging gap, it can be said that if it is not kept to at least 75 μm under an environment where ambient temperature is between 10 and 32° C. regardless of a change in temperature, charging irregularity can easily occur.

Next, the present applicants have experimentally produced the following matter as the charging roller 10. Specifically, first of all, a resin composition (volume resistivity of $10^6$ Ωcm), which is obtained by compounding a 60 wt % of ion conductive agent composed of a polyolefin polymer compound having a quaternary ammonium base into a 100 wt % of a base resin, was injection molded to have a thickness of several [mm] throughout the entire circumference of the central portion of the main axis portion (11*b*), which is made from stainless and has a diameter of 9 [mm]. Accordingly, the discharging member (13) made of a thermoplastic resin was fixed to the central portion of the main axis portion (11*b*). Next, the ring-like abutting roller (12), which is obtained by molding a thermoplastic resin to have an inner diameter of low 9 [mm], an external diameter of dozen [mm], and a length of 8 [mm] in the direction of the axis line, was press fitted and bonded to each end portion of the main axis portion (11*b*). Then, thus obtained roller was subjected to precise molding by a lathe turning and cutting machine. Specifically, by means of a lathe turning and cutting process, the discharging member (13) was subjected to cutting to obtain a diameter of 11 [mm], and at the same time the abutting rollers (12) were subjected to a cutting to obtain a diameter of 11.09 [mm]. In this manner, by fixing both discharging member (13) and abutting rollers (12) to the main axis portion (11*b*), and thereafter subjecting them to cutting to finish their diameters, gap fluctuation in the circumferential direction of the charging roller 10, which is caused by the eccentricity at the time of lathe turning and cutting, can be resolved. Specifically, the lathe turning and cutting machine cannot finish a cutting article to obtain a perfect circle. The reason is that it is inevitable that the workpiece is rotated in a slightly eccentric state due to limited form accuracy in a chuck holding the workpiece. Supposed that the discharging member (13) fixed to the main axis portion (11*b*) is processed and finished by means of the lathe turning and cutting process that generates such slight eccentricity, and at the same time the abutting rollers (12) are fixed to the main axis portion (11*b*) after being finished by means of lathe turning. As a result, the eccentricity phase of the discharging member (13) and the eccentricity phase of the abutting rollers (12) deviate in the circumferential direction of the charging roller 10, thereby causing gap fluctuation in the circumferential direction. On the other hand, if the both are fixed to the main axis portion (11*b*), and thereafter the diameters are finished by means of the lathe turning and cutting process, the eccentricity phase of both can be made uniform, thus gap fluctuation caused by the eccentricity at the time of lathe turning and cutting can be resolved.

As described above, the present applicants have experimentally produced thirteen types of charging rollers (10) referred to as charging rollers A through M in which the resin material of the discharging member (13) and the resin material of the abutting rollers (12) are different. Specific configurations of these charging rollers are as follows.

[Roller A]

First, a resin composition (volume resistivity of $10^6$ Ωcm), which is obtained by compounding a 60 wt % of ion conductive agent composed of a polyolefin polymer compound having a quaternary ammonium base into a 100 wt % of an ABS resin (acrylonitrile butadiene styrene copolymer), was prepared. Then, this resin composition was injection molded on the peripheral surface of the axis member 11 which is made from stainless and has a diameter of 9 [mm], and a discharging member (13) having a 11 [mm] external diameter was obtained. Next, ring-like abutting rollers (12), the external diameters of which slightly exceed 11 [mm], were press fitted and bonded to both end portions of the axis member (11) so that they are aligned on both sides of the discharging member (13). For the abutting rollers (12), the one made of hydrin (epichlorhydrin rubber) was used. Moreover, when the degree of hardness (JIS D) of the discharging member (13) was measured, it was 63 [degrees].

[Roller B]

Except that the abutting rollers (12) made of EEA (ethylene-ethyl acrylate copolymer) was used, the charging roller was created in the same manner as in the roller A.

[Roller C]

Except that the abutting roller (12) made of HDPE (high density polyethylene) was used, the charging roller was created in the same manner as in the roller A.

[Roller D]

Except that the abutting roller (12) made of PP (polypropylene) was used, the charging roller was created in the same manner as in the roller A.

[Roller E]

Except that the abutting roller (12) made of POM (polyoxymethylene=polyacetal) was used, the charging roller was created in the same manner as in the roller A.

[Roller F]

Except that the abutting roller (12) made of ABS (acrylonitrile butadiene styrene copolymer) was used, the charging roller was created in the same manner as in the roller A.

[Roller G]

First, a discharging member (13) made of EEA (ethylene-ethyl acrylate copolymer) and having an external diameter of 11 [mm] was formed on the peripheral surface of the axis member 11 made from stainless and having a 9 [mm] diameter. Next, ring-like abutting rollers (12), the external diameters of which slightly exceed 11 [mm], were press fitted and bonded to both end portions of the axis member (11) so that they are aligned on both sides of the discharging member (13). For the abutting rollers (12), the one made of hydrin (epichlorhydrin rubber) was used. Moreover, when the degree of hardness (JIS D) of the discharging member (13) was measured, it was 44 [degrees].

[Roller H]

Except that the abutting rollers (12) made of EEA (ethylene-ethyl acrylate copolymer) was used, the charging roller was created in the same manner as in the roller G.

[Roller I]

Except that the abutting roller (12) made of HDPE (high density polyethylene) was used, the charging roller was created in the same manner as in the roller G.

[Roller J]

Except that the abutting roller (12) made of POM (polyoxymethylene=polyacetal) was used, the charging roller was created in the same manner as in the roller G.

[Roller K]

First, a discharging member (13) made of hydrin (epichlorhydrin rubber) and having an external diameter of 11 [mm] was formed on the peripheral surface of the axis member 11 made from stainless and having an 8 [mm] diameter. Next, ring-like abutting rollers (12), the external diameters of which slightly exceed 11 [mm], were press fitted and bonded to both end portions of the axis member (11) so that they are aligned on both sides of the discharging member (13). For the abutting rollers (12), the one made of hydrin (epichlorhydrin rubber) was used. Moreover, when the degree of hardness (JIS D) of the discharging member (13) was measured, it was 33 [degrees].

[Roller L]

Except that the abutting roller (12) made of HDPE was used, the charging roller was created in the same manner as in the roller K.

[Roller M]

Except that the abutting roller (12) made of ABS was used, the charging roller was created in the same manner as in the roller K.

A reference image was continuously output to 10,000 transfer papers, while sequentially replacing these thirteen types of charging rollers (10) with respect to the abovementioned converter. Then, an experiment was performed in which a fluctuation of the charging gap due to change in ambient temperature between 10 and 32 [° C.], the degree of hardness of the discharging member (13), the degree of hardness of the abutting rollers (12), and the exterior of the photoconductor were examined. Specifically, the converter with built-in charging roller was let stand for at least 12 hours under an environment where ambient temperature was 10° C. and humidity was 15% or an environment where ambient temperature was 32° C. and humidity was 54%, and thereafter the charging gap in the same environment was measured. It should be noted that the ambient temperature between 10 and 32° C. is a temperature range which is generally set as a range of performance assurance temperature.

In terms of the degree of hardness, it does not indicate the degree of hardness of the materials of the discharging member (13) and abutting rollers (12), and the degree of hardness which is obtained by using a hardness meter that meets JIS K 7215 was measured.

The charging gap was thoroughly measured not only in a predetermined section in the direction of the axis line of the charging roller (10) but also throughout the entire region in the direction of the axis line of the discharging member (13). It is necessary to set the charging gap between 15 through 75 [μm], as described above. However, considering that the charging gap fluctuates according to a change in the degree of hardness and in volume of the discharging member (13) and abutting rollers (12) due to the environmental fluctuation, it is preferred that the charging gap be 40 through 50 [μm] which are intermediate between 15 and 75 [μm]. Also, considering that the charging gap becomes large or small upon reaching the intermediate value, or that a gap error is generated for each member, it is preferred that the fluctuation of the charging gap according to the environmental fluctuation between 10° C. and 32° C. be 20 [μm] or less. Therefore, the charging rollers were evaluated by putting o and X respectively to the rollers where the charging gap fluctuation due to an environmental fluctuation between 10° C. and 32° C. was 20 [μm] or less and the rollers where the charging gap fluctuation was 21 [μm] or less.

As the photoconductor (2), a photoconductor was used in which an under layer with a 3.5 [μm] thickness, a charge generation layer with a 0.15 [μm] thickness, a charge transport layer with a 22 [μm] thickness, and a surface protection layer with a 5 [μm] thickness are sequentially laminated on a surface of an aluminum base pipe having a 30 [mm] diameter. Of these layers, the surface protection layer was formed by means of spray coating. The rest of the layers were formed by means of dip coating. Polycarbonate was used as a binder resin for the charge transport layer and the surface protection layer. Alumina particles with an average diameter of 0.3 [μm] were added to the binder resin of the surface protection layer at a rate of 10 wt % with respect to the total solid. The surface of the photoconductor (2) was examined after outputting to 10,000 papers, and the degree of damage on the surface was evaluated by putting ● (same as the initial state), o (slight damage was found), and X (rough surface and tarnish was found).

A result of this experiment was shown in FIG. 9.

According to the result shown in FIG. 9, it can be said that it is necessary to use the abutting rollers (12) and discharging member (13) in which the degree of hardness (JIS D) of the materials thereof are at least 44 degrees, in order to control the charging gap fluctuation due to the environmental fluctuation between 10 and 32 [° C.] to 20 [μm] or less. In other words, by using the abutting rollers (12) in which the degree of hardness (JIS D) is at least 44 degrees, and also using the discharging member (13) in which the degree of hardness (JIS D) is at least 44, the charging gap can be kept in the range of 15 through 75 [μm] under an environment where ambient temperature is 10 through 32 [° C.], regardless of the temperature fluctuation.

Therefore, in the printer according to the present embodiment, the abutting rollers (12) in which the degree of hardness (JIS D) is at least 44 degrees, and the discharging member (13) in which the degree of hardness (JIS D) is at least 44 are used. Further, the charging gap under an environment where ambient temperature is 10 through 32 [° C.] is set between 15 and 75 [μm]. This process unit having such a configuration can securely control toner adhesion or charging irregularity on the discharging member (13) caused by fluctuation of the charging gap, compared to the prior and existing charging device, which is under development, in which the charging gap could not be kept in the abovementioned range.

It is preferred that the diameter of the main axis portion 11*b* of the axis member 11 be 6 through 10 [mm]. If the diameter is too small, it causes a large deflection when a lathe turning and cutting process described hereinafter is performed and when it is pressed against the photoconductor 2, whereby it becomes difficult to keep the charging gap to a stable value. If the diameter is too large, on the other hand, it becomes difficult to respond to miniaturization and reduction in weight cased in near future.

It is preferred that the volume resistivity of the discharging member 13 be adjusted to $10^4$ through $10^9$ [Ωcm]. If the resistivity is too low, charging irregularity is generated easily since the discharging state becomes uneven due to small resistivity irregularity. Moreover, if the resistivity is to high, discharge cannot be generated sufficiently, and a uniform charging potential cannot be obtained easily. The electrical resistivity of the charging member can be adjusted by changing the quantity of the conductive material blended with a resin as the base material. For the resin as the base material, polyethylene, polypropylene, polymethylmethacrylate, polystyrene, acrylonitrile butadiene styrene copolymer (ABS), polycarbonate, or the like can be used. These are all thermoplastic resins and have a good formability, thus forming processing can be performed easily. As the conductive material compounded into the resin as the base material, an ion conductive material is preferred. By uniformly compounding such ion conductive material, resistivity irregularity of the discharging member 13 can be prevented. Polyolefin having a quaternary ammonium base, such as polyethylene and polypolyolefin, is particularly preferred as the ion conductive material. Moreover, the ion conductive material can be uniformly compounded into the resin by means of a biaxial kneading machine, kneader, or the like. Furthermore, it is preferred that the blend ratio of the ion conductive material to the resin as the base material be 30 through 80 wt % of the ion conductive material to 100 wt % of the resin.

The thickness of the discharging member 13 is set to a range of 0.3 through 3.0 [mm], preferably 0.5 through 2.0 [mm] in the present printer. The reason is as described hereinafter. Specifically, if it is less than 0.5 [mm], formation becomes difficult, and a problem arises in terms of the intensity. If it exceeds 2.0 [mm], the charging roller 10 becomes larger, and charging efficiency decreases due to the increase in a resistance capacitance.

As the material of the abutting rollers 12, propylene, polybutene, polyisoprene, ethylene-ethyl acrylate copolymer, ethylene-methyl acrylate copolymer, ethylene-vinyl acetate copolymer, ethylene-propylene copolymer, ethylene-hexene copolymer, or the like can be used. As with the base material of the discharging member 13, a resin such as polyethylene, polypropylene, polymethylmethacrylate, polystyrene, acrylonitrile butadiene styrene copolymer, polycarbonate, or the like can be used. Furthermore, as a resin material which has an excellent sliding property and hardly damages the photosensitive layer of the photoconductor 2, polyvinylidene fluoride, tetrafluoroethylene-perfluoroalkyl vinyl ether copolymer, tetrafluoroethylene-hexafluoropropylene copolymer, or the like can be used.

In the present printer, the difference in the degree of hardness (JIS D) between the discharging member (13) and the abutting rollers (12) is set to 15 degrees or less. The reason is as described hereinafter. Specifically, the discharging member (13) and abutting rollers (12) of the charging roller (10) are subjected to a lathe turning and cutting process together in a state where they are fixed to the main axis portion (11*b*) of the axis member. In the lathe turning and cutting process, an appropriate process condition is different according to the degree of hardness of a workpiece. Therefore, if the difference in the degree of hardness between the discharging member (13) and the abutting rollers (12) is too large, it becomes difficult to process both with a high degree of accuracy. According to the experiments carried out by the present applicants, by setting the difference in the degree of hardness (JIS D) to 15 degrees or less, it was able to effectively control deterioration of processing accuracy due to the difference in the degree of hardness.

For the abutting rollers (12), the one having the degree of hardness lower than that of the photoconductor 2 is used. In this way, damage, wear, and dent on a roller abutting portion in the photoconductor 2 can be controlled significantly as compared to the case in which an abutting roller having the degree of hardness harder than that of the photoconductor 2 is used. In addition to the fact that the degree of hardness of the abutting rollers (12) is higher than that of the photoconductor 2, the abutting rollers (12) have a condition that the degree of hardness (JIS D) is 70 degrees or less. If the degree of hardness is 70 degrees or less, the photosensitive layer of a general photoconductor can be securely prevented from being damaged.

In the present printer, the fluctuation width of the charging gap per rotation of the charging roller (10) under an environment where temperature is between 10 and 32° C. is set to 40 [μm] or less. The reason is as described hereinafter. Specifically, the charging bias is set in accordance with a maximum value in the fluctuation width of the charging gap in order to cause the photoconductor (2) to be charged securely. When performing such setting, there is not much of a problem if the fluctuation width is not too big. However, if the fluctuation width is too big, the charging bias becomes too big when the fluctuation width reaches a minimum value per rotation of the charging roller. By causing the photoconductor (2) to be charged by the overly large charging bias at this moment, filming by toner adhesion suddenly occurs easily in the charging section. According to the experiments carried out by the present applicants, it was confirmed that, if the fluctuation width exceeds 40 [μm], such filming starts to occur suddenly.

As a combination of the discharging member (13) and the abutting rollers (12), under an environment where temperature is between 10 and 32° C., the one in which the thickness is in a range 0.5 through 2.0 [mm], and the difference in linear expansion coefficient between both is $50\times10^{-5}$ [1/° C.] or less is used. The reason is as described hereinafter. Specifically, in the charging roller 10 having the configuration shown in FIG. 4, various factors are involved in the fluctuation of the charging gap occurred due to a temperature fluctuation. These factors include a change in the degree of hardness of the abutting rollers 12 due to the temperature fluctuation, and a change in the diameters of the discharging member 13 and abutting rollers 12 due to the temperature fluctuation. Of these factors, the change in the degree of hardness of the abutting rollers 12 can be controlled within a certain degree of range by using abutting rollers 12 having at least 44 degrees of hardness (JIS D). This is because, in a general thermoplastic resin, a change in the degree of hardness due to change in temperature becomes small as the degree of hardness thereof increases. However, the linear expansion coefficient, thickness, or the like of the resin material is involved in the change of the diameter, thus it is difficult to adjust them by means of only the degree of hardness. For example, even if using a discharging member 13 and abutting rollers 12 in which the materials thereof have the same linear expansion coefficient, the original diameters of the both are different, whereby the rate of diameter change in accordance with the change of temperature of the both becomes different. Accordingly, the charging gap fluctuates due to the change in temperature. The present applicants have confirmed through the experiments that the fluctuation of the charging gap due to the change in temperature can be controlled effectively by using a combination of the discharging member and abutting rollers in which the thickness is in a range of 0.5 to 2.0 [mm] and the difference in linear expansion coefficient between the both is $50\times10^{-5}$ [1/° C.] or less under an environment where temperature is between 10 and 32° C.

The combination of the discharging member 13 and the abutting rollers 12 has a condition that the difference in linear expansion coefficient becomes $50\times10^{-5}$ [1/° C.] or less and that the linear expansion coefficients of both are $50\times10^{-5}$ [1/° C.] or less. The reason is that the experiments carried out by the present applicants have confirmed that, with such conditions, the fluctuation of the charging gap due to change in temperature can be controlled more effectively.

Moreover, as the combination of the discharging member (13) and the abutting rollers (12), the one having a relational expression shown in Equation (1) below is used. However, in the following equation, $Rc_{10}$, $Rc_{30}$, $Rg_{10}$, and $Rg_{30}$, indicate the external diameter of the discharging member 13 under an environment where temperature is 10° C., the external diameter of the discharging member 13 under an environment where temperature is 30° C., the external diameter of the abutting roller 12 under an environment where temperature is 10° C., and the external diameter of the abutting roller 12 under an environment where temperature is 30° C., respectively.

$$|(Rc_{30}-Rc_{10})-(Rg_{30}-Rg_{10})|\leqq 20\ \mu m \qquad \text{Eq. (1)}$$

This equation indicates that a value, which is obtained by subtracting the difference between the diameter $Rg_{30}$ of the abutting roller 12 under an environment where temperature is 30° C. and the diameter $Rg_{10}$ of the abutting roller 12 under an environment where temperature is 10° C., from the difference between the diameter $Rc_{30}$ of the discharging member 13 under an environment where temperature is 30° C. and the diameter $Rc_{10}$ of the discharging member 13 under an environment where temperature is 10° C., is 20 [μm] or less. Specifically, the equation indicates that the difference in diameter between the discharging member 13 and the abutting roller 12 becomes 20 [μm] or less at most, when the temperature changes from 10° C. to 32° C. With this condition, it is possible to effectively control fluctuation of the charging gap which occurs because of the change in the diameters of the discharging member 13 and the abutting roller 12 due to the temperature fluctuation.

Further, a combination of the discharging member 13 and the abutting rollers 12, which has a condition that the linear expansion coefficient of the abutting rollers 12 is larger than that of the discharging member 13, is used. The reason is as described hereinafter. Specifically, in the charging roller 10 having the configuration shown in FIG. 4, the relationship between the temperature change and the direction of the change of the charging gap can be set freely, depending on what materials are chosen for the discharging member 13 and the abutting rollers 12. Specifically, the charging gap can be widened or narrowed down as the temperature increases. On the other hand, in a general resin material, its electrical resistance increases as the temperature decreases, thus, when a bias value applied to the resin material is constant, the surface potential thereof becomes small as the temperature decreases. Consequently, it becomes difficult for the discharging member 13 to discharge in the decreased temperature. This means that the charging capability is lowered as the temperature decreases. Therefore, in the present printer, as the temperature decreases, the charging gap is narrowed, whereby the decrease in the charging capability due to increase in the electrical resistance is offset, and a variation of the charging capability, which is caused by change in the electrical resistance of the discharging member 13 due to change in the temperature, is controlled. More specifically, the abutting rollers 12 are thicker than the discharging member 13. As such abutting rollers 12, when using abutting rollers having a linear expansion coefficient which is larger than that of the discharging member 13, the charging gap becomes smaller as the temperature decreases.

It should be noted that the linear expansion coefficients may be measured by a method that meets JIS K 7197, and the external diameters of the discharging member 11 and the abutting rollers 12 of the finished charging roller 10 may be measured for every temperature.

For the abutting rollers 12, the ones in which the sum of the abutting lengths between the photoconductor 2 in the direction of the roller axis line and the abutting rollers is 6 through 18 [mm]. In the present printer, two abutting rollers 12 having the same length in the direction of the axis line are used, and the length is 3 through 9 [mm]. The reason that the abutting lengths are adjusted in this manner is as described hereinafter. Specifically, the pressure per unit length of the abutting portions between the photoconductor 2 and the abutting rollers 12 is determined by pressure applied from the abutting rollers 12 to the photoconductor 2 and the sum of the abutting lengths. Even if the same pressure is applied, if the sum of the abutting lengths becomes small, the pressure per unit length of the abutting portions becomes large. According to the experiments carried out by present applicants, it was confirmed that, if the sum of the abutting lengths is less than 6 [mm], damage to the photoconductor surface caused by the pressure per unit length of the abutting portions drastically develops. The abutting sections between the photoconductor 2 and the abutting rollers 12 are covered with an insulating photosensitive layer, but if damage to the photoconductor surface drastically develops, the photosensitive layer is lost due to wear, whereby the conductive material as a substrate is exposed. Consequently, charge of the photosensitive layer leaks to the conductive material, whereby good charging cannot be performed. Therefore, the sum of the abutting lengths is set to at least 6 [mm] to control the development of wear of the photosensitive layer. It should be noted that the abutting portions on the photoconductor 2 with respect to the abutting rollers 12 rightly have to be image non-formation regions of the photoconductor 2. When the sum of the abutting lengths is set bigger than 18 [mm], the photoconductor 2 and charging roller 10 have to be extended overly, which disturbs miniaturization of the device.

Moreover, the abutting rollers 12 in which a surface friction coefficient is 0.3 or less is used. By using such abutting rollers 12, wear of the surface of the photoconductor 2 caused by a friction with the abutting rollers 12 can be prevented, and fluctuation in the rotation speed caused by a friction between the both can be prevented. It should be noted that the surface friction coefficient here means a coefficient of static friction which is calculated by means of Euler belt equation. Normally, a frictional coefficient with respect to the photoconductor 2 should be obtained, but a measurement value is influenced by the frictional coefficient of the photoconductor surface, thus a frictional coefficient with respect to, not the photoconductor 2, but a PET film is measured. Specifically, a charging roller 10, in which the end portions thereof are provided respectively with 5 [mm] long abutting rollers 12 for measurement in the direction of the axis line, is fixed to a seat. Then, a PET film (OHP Film Type ST produced by Ricoh Company), which was cut into 297 [mm] long, is set on the photoconductor 2. Next, a 100 g weight is attached to an end portion of the PET film, and a digital force gage is attached to another end portion. Then, based on the following equation, a coefficient of static friction ps is calculated from a load at the time when the digital force gage starts to move at a constant speed.

$$\mu s = 2/\pi \times 1n\ (F/W) \qquad \text{Eq. (2)}$$

where

μs: coefficient of static friction

F: read load

W: heaviness of weight

π: circle ratio

The pressure applied from the abutting rollers 12 to the photoconductor 2 is set to 0.05/g through 0.2/g [N/mm] (where g is gravity acceleration: 9.80665). This is equivalent to 50 through 200 g [gf/mm]. The reason of such setting is as described hereinafter. Specifically, if the applied pressure is below 50/g[N/mm], it is difficult for the applied pressure to overcome the rotary force of the photoconductor 2 which pushes the charging roller 10 in the direction opposite of the pressure direction, and to be applied nicely, whereby the abutting rollers 12 bounce easily. Further, if the applied pressure exceeds 0.2/g[N/mm], this excessive abutting pressure disturbs smooth rotation of the photoconductor 2 or the charging roller 10.

In addition, a discharging member 13 having a multilayered structure is used, in which a substrate layer (base layer) made of the abovementioned base material resin is covered with a surface layer made of a substance which is less adherent to the toner than the base material. After finishing the external diameter of the base layer by means of lathe turning and cutting, a precursor material of the surface layer is applied to the surface of the base material by means of spray coating, and the surface layer is formed. In such a configuration, toner stain on the discharging member 13 can be controlled as compared to the case in which the substrate layer made of the base material resin is exposed. As a method of forming the surface layer, a method disclosed in Japanese Patent Application Laid-Open No. 2003-76116 can be used. Specifically, a coating material, which is obtained by dispersing an acrylic skeleton, a ceramic hybrid material containing polysiloxane, a curing agent, and conductive molecules into organic solvent, is created, and the base layer surface is coated with thus obtained coating material by means of spray coating or dipping, which is then cured through a heating process. An isocyanate material can be used as the curing agent. A conductive metallic oxide such as tin oxide, carbon black, or the like can be used as the conductive molecule. If the thickness of the surface layer is too thin, it becomes difficult to over the surface of the discharging member 13 evenly, and, if the thickness of the surface layer is too thick, heating processing needs to be performed, thus it is preferred that the thickness of the surface layer be 5 through 20 μm.

It should be noted that it is not preferred to use the abutting rollers 12 in which the surface layer is formed on the substrate layer. This is because, since the abutting rollers 12 have friction with the photoconductor 2, the thin surface layer falls off easily, which causes fluctuation of the charging gap.

Therefore, when the precursor material of the surface layer is applied to the base layer of the discharging member 13 by means of spray coating, the abutting rollers 12 are subjected to masking, and then the precursor material is attached to the discharging member 13 only.

Furthermore, as a combination of the discharging member 13 and the abutting rollers 12, a combination as follows is used. Specifically, a step of the both in the thickness directions under an environment where temperature is between 10 and 32 [° C.] is between 40 and 60 [μm], and the straightness of the discharging member 13 in the direction of the axis line under the same environment is 20 [μm] or less. By using this combination having such a configuration, the charging gap can be easily set within a range of 15 to 75 [μm]. It should be noted that the straightness is an index indicating the degree of straightness of the surface of an object to be examined, and this can be measured as follows. Specifically, a roller as an object to be examined is set in parallel using an automatic roller measuring device RSV640PC produced by Tokyo Opto-Electronics. Setting in parallel means setting the roller so that the distances between each end of the roller surface and a reference line created by the measuring device are the same. After setting in this manner, the distance between the roller surface and the reference line is measured sequentially at 10 [mm] intervals in the direction of the roller axis line. Next, the roller is rotated by 90 degrees, and the same measurement is performed. After performing the measurement four times for 0 degree rotation, 90 degree rotation, 180 degree rotation, and 270 degree rotation, the measuring device is caused to obtain the straightness on the basis of all measurement results.

Moreover, the discharging member 13 and abutting roller 12 made of a thermoplastic resin are used. Since a thermoplastic resin is a material which can be molded extremely easily, the discharging member 13 and abutting rollers 12 can be molded easily. Moreover, after molding, abutting members 12 and discharging member 13 having a high degree of hardness of 44 at least degrees can be obtained easily.

In the present printer, a discharging member 13 in which the base layer and the surface layer are made of a conductive resin is used, and abutting rollers 12 made of an insulating resin is used. By using the discharging member 13 in which the base layer and the surface layer are made of a conductive resin, a charging bias applied to the axis member 11 can be caused to conduct o the discharging member 13, and the discharging member 13 can be caused to discharge. By using the abutting rollers 12 made of an insulating resin, increase in the surface potential of the abutting rollers 12 due to application of the charging bias can be blocked, and it is possible to avoid a situation where the toner on the photoconductor 2 is caused to electrostatically moved to the abutting rollers 12 by the increase of the surface potential.

As a combination of the discharging member 13 and abutting rollers 12, the following combination is used, that is, a combination in which the electrical resistivity of the abutting rollers 12 is higher than $1\times10^9$ [Ωcm], the electrical resistivity of the discharging member 13 is lower than $1\times10^9$ [Ωcm], and a value obtained by dividing a value of the electrical resistivity of he abutting rollers 12 by a value of the electrical resistivity of the discharging member 13 is smaller than $1\times10^5$. By allowing the combination to have such a condition, a good charging performance can be achieved with respect to the discharging member 13, and discharge from the abutting rollers 12 can be securely prevented.

For the abutting rollers 12, the ring-like inner circle parts thereof are not only press fitted to the main axis portion 11*b* of the axis member 11, but also bonded to the main axis portion 11*b* by means of an adhesive, and fixed to same by means of resistance torques of at least 4/g [N/cm] (equivalent to 4 kgf/cm). In this manner, when subjecting the fixed abutting rollers 12 to lathe turning and cutting, eccentric phase shift between the abutting rollers 12 and the discharging member 13 caused by the abutting rollers 12 slipping on the main axis portion 11*b* can be prevented.

Figure 10:
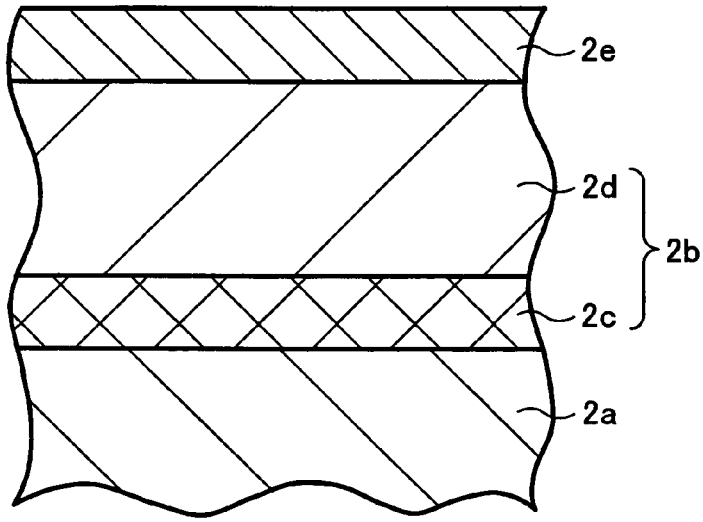
FIG. 10 is a vertical cross-sectional view partially showing a configuration of the photoconductor.
Figure 11:
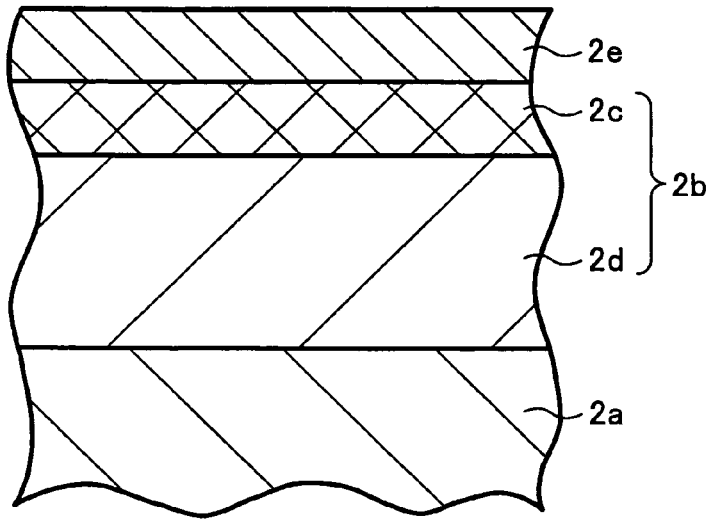
FIG. 11 is a vertical cross sectional view partially showing a modified example of the photoconductor.

FIG. 10 is an enlarged vertical cross-sectional view which partially shows the photoconductor 2 of the present printer. In this figure, in the photoconductor 2, a conductive support body 2*a* configured by a base pipe made of aluminum or other metal is covered with a photosensitive layer 2*b* and a surface protection layer 2*e*. The photosensitive layer 2*b* is divided into a charge generation layer 2*c* and a charge transport layer 2*d* from the conductive support body 2*a* side. It should be noted that, as shown in FIG. 11, the positions of the charge generation layer 2*c* and charge transport layer 2*d* may be reversed. Further, an unshown under layer may be provided between the conductive support body 2*a* and the photosensitive layer 2*b*.

An aluminum or stainless metallic tube, which achieves conductivity of $10^4$ [Ωcm] or less with the volume resistivity, can be used as the conductive support body 2*a*. A matter obtained by forming a metal such as nickel into the shape of an endless belt may be used.

As a material for the under layer, a material having a resin as a main constituent can be used. However, when a material in which a resin is dissolved in a solvent is applied on the under layer to form the photosensitive layer 2*b*, it is preferred that a resin which is highly melt proof with respect to organic solvent be used as the resin of the under layer. Examples of such resin include a water soluble resin such as polyvinyl alcohol, an alcohol-soluble resin such as copolymerized nylon, a cured resin which forms a three-dimensional network, such as polyurethane, alkyd-melamine, and epoxy, and other resins.

Metallic oxide fine powder such as titanium oxide, silica, and alumina may be added to the under layer in order to prevent moire, reduction of a residual potential, and the like. By coating the conductive support body 2*a* with a resin dissolved in an appropriate solvent, the under layer can be created. It should be noted that the thickness of the under layer is preferably approximately 0 to 5 [μm].

The charge generation layer 2*c* is a layer having a charge generation material as a main constituent. Examples of the charge generation material include a monoazo pigment, disazo pigment, trisazo pigment, and phthalocyanine pigment. By dispersing these charge generation materials along with a binder resin such as polycarbonate into a solvent such as tetrahydrofuran or cyclohexane, and applying thus obtained dispersions, the charge generation layer 2*c* can be formed. Application of the dispersions can be performed by means of dip coating or spray coating. It is preferred that the thickness of the charge generation layer 2*c* be approximately 0.01 through 5 [μm].

The charge transport layer 2*d* can be formed by dissolving or dispersing a charge transport material and a binder resin in an appropriate solvent such as tetrohydrofuran and dichlorethane, and applying and drying thus obtained dispersions. It is preferred that its thickness be approximately 15 through 40 [μm]. In charge transport materials, there are an electron transport material and an electron hole transport material for a low-molecular charge transport material.

As the electron transport material, there is, for example, an electron receptor substance such as include chloranil, bromanil, tetracyanoethylene, tetracyanoquinodimethan, 2,4,7-trinitro-9-fluorenon, 2,4,5,7-tetranitro-9-fluorenon, and 1,3, 7-trinitrodibenzothiophene-5,5-dioxide. Moreover, as the electron hole transport material, there is, for example, an electron donor substance such as an oxazole derivative, oxadiazole derivative, imidazole derivative, triphenylamine derivative, phenylhydrazone group, α-phenylstilbene derivative, tiazole derivative, triazole derivative, phenazine derivative, acridine derivative, and thiophene derivative.

An example of the binder resin used along with the charge transport material in the charge transport layer is a thermoplastic or thermoset resin such as polystyrene, styrene-acrylonitrile copolymer, styrene-butadiene copolymer, polyester, polyallylate, polycarbonate, acryl, epoxy, melamine, or phenol.

As the surface protection layer 2*e,* a surface protection layer in which a metallic oxide fine particles are dispersed in a binder resin can be used. An example of the binder resin is a resin such as styrene-acrylonitrile copolymer, styrene-butadiene copolymer, acrylonitrile-butadiene-styrene copolymer, olefin-vinylmonomer copolymer, chlorinated polyether, aryl, phenol, polyacetal, polyamide, polyamide-imide, polyacrylate, polyarylsulfone, polybutyrene, polybutyreneterephthalate, polycarbonate, polyethersulfone, polyethylene, polyethyleneterephthalate, polyimide, acryl, polymethylpenten, polypropyrene, polyphenylenoxide, polysulfone, polyurethane, polyvinyl chloride, polyvinylidene chloride, or epoxy. Examples of the solvent in which the binder resin is dissolved or dispersed include tetrahydrofuran, toluene, and dichlorethane. Examples of the metallic oxide fine particles dispersed in the binder resin include alumina, silica, titanium oxide, tin oxide, zirconium oxide, and indium oxide. By dispersing such metallic oxide fine particles, excellent abrasion resistance can be achieved to extend the life of the abutting portions between the charging roller (10) and the abutting rollers 12.

The loadings of the metallic oxide fine particles contained in the surface protection layer 2*e* is preferably 5 through 40% and suitably 8 through 30%. If the loadings is less than 5%, the abrasion resistance decreases drastically, and if it exceeds 40%, increase in the potential of a bright section at the time of exposure becomes significant, decrease of the sensitivity cannot be ignored. It is appropriate that the particle diameter of the metallic oxide particles be 0.1 through 0.8 [μm]. If the diameter exceeds 0.8 [μm], unevenness of the surface protection layer 2*e* becomes large, lowering the cleaning property, and the resolution decreases due to scattering of light for exposure, whereby the quality of an image is reduced. If the diameter is less than 0.1 [μm], excellent abrasion resistance cannot be obtained.

The surface protection layer 2*e* can be formed by means of spray coating or the like. It is appropriate that the thickness thereof be 1 through 10 μm, preferably approximately 3 through 8 μm. If it is too thin, the durability decreases. If the thickness of the protection layer is made too thick, productivity when producing the photoconductor decreases, and increase in the residual potential becomes large with time.

Excellent durability can be achieved even when a surface protection layer made of a crosslinking resin as disclosed in Japanese Patent Application Laid-Open No. 2000-275877 is used as the surface protection layer 2*e* instead of the one in which the metallic oxide particles are dispersed in the binder resin. As the crosslinking resin, not only siloxane disclosed in the same patent application, but also a photocrosslinking (photo-curing) resin or heat crosslinking (thermoset) resin may be used.

A lubricant may be dispersed in the binder resin used in the surface protection layer 2*e* in order to further improve the abrasion resistance. As the lubricant, there is, for example fluorine resin particles. Specifically, the examples are polytetrafluoroethylene, polyhexafluoropropyrene, polytrifluoroethylene, polyvinyldene fluoride, polyvinyl fluoride, or he like. The loadings of these fluorine resins is a 20 through 60 wt % content with respect to the total solid. If it is less than 20 wt %, an improvement effect on the lubricating property becomes small, and, if it exceeds 60 wt %, the strength of the film decreases. Further, it is appropriate that the particle diameter of the fluorine resin be 0.1 through 2 [μm].

Moreover, a dispersing agent may be added to the binder resin used in the surface protection layer 2*e* in order to improve the dispersion properties of the abovementioned metallic oxide particles or lubricant particles. The dispersion agent may be the one used in a general coating material.

A charge transport material can be added to the surface protection layer 2*e,* and an antioxidant can also be added to the surface protection layer 2*e* according to need.

A photoconductor (2), in which the photosensitive layer 2*b* is added not only to the latent image forming region in the direction of the drum axis line, but also to the non-latent image forming region, is used. Specifically, in the photoconductor (2) of the present printer, deterioration of the photosensitive layer 2*b* is generated by the rollers being abut in the abutting regions of the charging roller (10) and the abutting rollers (12) in the direction of the axis line of the photoconductor, thus it is not preferred to take this region as the latent image forming region. For this reason, a region located near the center, apart from the abutting region against the rollers is taken as the latent image forming region, and the abutting region is taken as the non-latent image forming region where a latent image is not formed. In the latent image forming region where a latent image is formed, the present printer forms an image while conveying A3 paper as the largest size of paper in the vertical direction (longitudinal direction), thus the latent image forming region is made larger compared to the length of the width direction. The photosensitive layer 2*b* needs to be formed in this latent image forming region, but the photosensitive layer 2*b* does not need to be formed in the non-latent image forming region. However, when the photosensitive layer 2*b* is not formed in the non-latent image forming region, the conductive support body 2*a* is exposed. Then, a discharge from the discharging member (13) of the charging roller (10) is sent to the exposed conductive support body 2*a* rather than to the insulating photosensitive layer 2*b,* thus some sort of an insulating layer has to be provided instead of the photosensitive layer 2*a.* While the photosensitive layer 2*b* is applied in the central portion (latent image forming region) of the conductive support body 2*a* in the direction of the axis, another insulating layer is applied in each end portion (non-latent image forming region). In such a layer structure, the layer formation steps increases, whereby the cost of production increases, compared to the case where the photosensitive layer 2*b* is applied to all the central portion and end portions. In addition, a connection line is generated between the photosensitive layer 2*b* of the latent image forming region and the insulating layer of the non-latent image forming region on each end side of the latent image forming region, and the connection line becomes weak. Therefore, in the present printer, the photosensitive layer 2*b* is formed in the non-latent image forming region as well, and the abutting rollers (12) are caused to abut thereon.

As the unshown power source as bias supply means for supplying a charging bias to the axis member (11) of the charging roller (10), the following is used. Specifically, the power source is to supply a charging bias in which an AC bias is superimposed on a DC bias. Moreover, as the AC bias, the one in which the frequency [Hz] thereof is more than seven times and less than twelve times a linear velocity [mm/sec] of the photoconductor (2) is imposed. The reason that such a charging bias is employed is as follows. Specifically, if the frequency of the AC bias is not more than seven times larger than the linear velocity, charging irregularity in the form of a stripe becomes distinct. Further, if the frequency is at least twelve times larger than the linear velocity, excessive discharge is generated, abrasion wear of the photoconductor is increased, and filming of toner or toner external additive is generated easily.

It should be noted that, when the DC bias is imposed on the AC bias, if the DC bias is subjected to constant current control, it is possible to make it difficult to have a fluctuation of the roller resistivity caused by an environment. However, in the configuration of the present printer in which the discharging member (13) and the photoconductor (2) of the charging roller (10) are disposed in a non-contact state, the charging gap fluctuates as the photoconductor or charging roller rotates, thus a high voltage power source cannot completely follow the charging gap fluctuation through the constant current control only, whereby an abnormal image is generated. For this reason, it is preferred that the AC bias be subjected to constant current control. Since the AC bias fluctuates according to fluctuation of the roller resistivity in an environment and the size of the charging gap, the AC bias can be detected, and it can be set to an appropriate AC voltage by adjusting AC voltage while monitoring AC current when non-image is formed.

As described above, in the present printer, as the photoconductor (2), the photoconductor having same conditions as the one used in the experiments carried out by the present applicants, the condition being that the thickness of the charge transport layer (2*d*) of the photosensitive layer (2*b*) is 20 through 35 [μm]. Therefore, the genicity of charging irregularity of the photoconductor can be evaluated accurately on the basis of the measurement results of the capacitance C1 in which a metallic body (aluminum drum) is used.

The charging device has the charging roller (10) as a rotating member in which the abutting rollers (12) as abutting members abut onto the photoconductor (2), and the discharging member (13) facing the photoconductor (2) with a predetermined charging gap are fixed to the rotatable axis member throughout the entire periphery of the axis member in the direction of rotation, and the charging gap is kept by the abutting rollers (12) abutting onto the photoconductor (2). In such a configuration, for the reasons mentioned above, the abutting rollers (12) which are thicker than the discharging member (13) can be fixed firmly to the axis member (11) by means of press fitting, bonding, and laminating methods. Therefore, decrease of durability caused by the abutting members falling off can be prevented.

Moreover, the abutting rollers (12) are not fixed to a relatively flexible substrate, which is made of a conductive rubber, but to a highly rigid axis member (11), thus it is possible to avoid a situation in which the abutting members are embedded significantly in the substrate which became too flexible in high environmental temperature. Therefore, fluctuation of the abovementioned gap which is caused by such penetration of the abutting members into the substrate is resolved, whereby toner adhesion on the discharging member (13) and charge irregularity caused by fluctuation of the charging gap can be prevented more securely than the charging device described in Japanese Patent Application Laid-Open No. 2001-194868.

Moreover, as the abutting rollers (12), it becomes possible to use abutting rollers which are not made from a heat shrinkable tube with which adjustment of a thickness deviation after contraction is difficult, but from a material such as a rigid plastic with which adjustment of a thickness deviation is performed easily. For this reason, toner adhesion on the discharging member and charge irregularity caused by fluctuation of the charging gap can be prevented more securely than the charging device described in Japanese Patent Application Laid-Open No. 2002-55508 in which the abutting rollers (12) made from a heat shrinkable tube were used.

In addition, in the present printer, the abutting rollers (12) in which the degree of hardness (JIS D) is at least 44 degrees, and the discharging member (13) in which the degree of hardness (JIS D) is at least 44 are used, fix the abutting rollers (12) to both end portions of the vicinity of the both ends of the axis member (11) in the direction of the axis line so as to interpose the discharging member (13) fixed to the axis member (11) between therebetween, and the gap under an environment where temperature is between 10 and 32° C. is set to a range of 15 through 75 [μm]. In such a configuration, for the reasons mentioned above, charging gap can be kept in the range of 15 through 75 [μm] under an environment where ambient temperature is 10 through 32 [° C.], regardless of the temperature. Therefore, toner adhesion onto the discharging member (13) and charging irregularity caused by fluctuation of the charging gap can be controlled more securely than the case in which the charging gap is not kept in this range.

Also, since the thickness of the discharging member (13) on the surface of the axis member (11) is between 0.3 through 2.0 [mm], enlargement of the charging roller (10) can be controlled while controlling the charging gap fluctuation caused by a thickness deviation of the discharging member (13) in the circumferential direction.

Since a thermoplastic resin is used as the material of the abutting rollers (12) and of the discharging member (13), the can be molded easily.

An insulating resin is used as the material of the abutting rollers (12), and a conductive resin is used as the material of the discharging member (13), thus the charging bias applied to the axis member (11) is caused to conduct to the discharging member (13) to cause the discharging member (13) to generate a discharge therefrom, and at the same time increase in the surface potential of the abutting rollers (12) due to application of the charging bias is blocked, whereby toner adhesion onto the abutting rollers caused by the increase of the surface potential can be prevented.

Further, as the latent image supporting body, a photoconductor in which a surface of an aluminum base pipe as a metallic substrate is covered with the photosensitive layer (2*b*) and the layer protection layer (2*e*) is used, thus deterioration of the photosensitive layer (2*b*) caused by the pressure of the abutting rollers (12) can be controlled by the surface protection layer (2*e*).

As the photoconductor (2), using a photoconductor in which the photosensitive layer (2*b*) is covered not only in the latent image forming region in the direction perpendicular to the direction of the surface migration of the photoconductor, but also in the non-latent image forming region in the same direction, the abutting rollers (12) are caused to abut onto the photosensitive layer (2*b*) in the non-latent image forming region. Therefore, compared to the case in which the photosensitive layer (2*b*) is not formed in the non-latent image forming region, the layer formation steps of the photoconductor (2) can be reduced and the production cost can be reduced. Furthermore, it is possible to avoid decrease in durability of the photoconductor (2) which is caused by generation of a connection line between the photosensitive layer (2*b*) in the latent image forming region and an insulating layer in the non-latent image forming region.

Moreover, there is provided a brush roller (3) which is lubricant applying means for applying a lubricant to the surface of the photoconductor (2), thus toner releasability for releasing the toner from the surface of the photoconductor (2) can be improved by applying the lubricant, and the toner transcriptional property for transferring the toner from the photoconductor (2) to the transfer paper can be improved.

As the power source of the charging bias which is the bias supply means, the power source, which supplies a charging bias in which an AC bias is superimposed on a DC bias, is used, wherein the frequency [Hz] of the AC bias is more than seven times and less than twelve times a linear velocity [mm/sec] of the photoconductor (2). Therefore, charging irregularity in the form of a stripe caused when the frequency of the AC bias is too small can be avoided, and increase of abrasion wear or filming generation in the photoconductor caused when the frequency is too large can be avoided.

Also, as the power source of the charging bias which is the bias supply means, a power source in which the AC bias is subjected to constant current control is used, thus the surface potential of the discharging member (13) can be made constant and stable charging performance can be achieved, regardless of fluctuation of the electric resistivity of the discharging member (13) due to change in temperature.

Second Embodiment

First of all, according to the experiments described hereinafter, the present applicants have discovered that, under an environment where ambient temperature is 10 through 32° C., which is a temperature range generally set as a range of performance assurance temperature for the image forming apparatus, toner adhesion to the discharging member can be effectively controlled by keeping the abovementioned gap to at least 15 [μm]. Moreover, the present applicants have discovered that charging irregularity in a charged body can be effectively controlled by keeping the gap to 75 [μm] or less under the same environment. The present applicants have further discovered that the gap can be kept within a range of 15 through 75 [μm] in the same environment regardless of the temperature, by using the abutting rollers in which the degree of hardness (JIS D) is at least 44 degrees, and also using the discharging member in which the degree of hardness (JIS D) is at least 44. Therefore, in the second embodiment, toner adhesion to the discharging member and charging irregularity due to fluctuation the gap can be controlled in the present charging device, compared to the abovementioned charging device, which is under development, in which the charging gap could not be kept in the abovementioned range.

The second embodiment is described in detail hereinafter. It should be noted that most of FIGS. 1 through 6 and 8 through 11 and the explanation for the first embodiment which is provided with reference to these figures is practically applied in the second embodiment, thus the overlapping explanation is omitted, and only the characteristics of the second embodiment are described hereinafter.

Specifically, in a printer related to the second embodiment, abutting rollers (12) as abutting members having the degree of hardness lower than that of a photoconductor (2) as a charged body are used. Therefore, compared to the case in which abutting rollers with the high degree of hardness are used, deterioration of abutting portions of the abutting rollers (12) with respect to the photoconductor (2) can be controlled.

Since the degree of hardness (JIS D) of the abutting rollers (12) is 70 degrees or less, damage on a photosensitive layer of a general photoconductor can be prevented securely.

Since the difference in the degree of hardness (JIS D) between the abutting rollers (12) and a discharging member (13) is 15 degrees or less, deterioration of accuracy of a lathe turning and cutting process to which the abutting rollers (12) are subjected, and accuracy of the lathe turning and cutting process to which the discharging member (13) is subjected can be effectively prevented, the deterioration being caused due to the difference in the degree of hardness.

Since the fluctuation width of the charging gap per rotation of the charging roller (10) that is a rotating member is 40 [μm] or less under an environment where ambient temperature is 10 through 32 [° C.], generation of filming on the photoconductor (2) caused by charging with an excessive charging bias can be prevented.

The thickness of the abutting rollers (12) on the surface of the axis member (11) of the charging roller (10), and the thickness of the discharging member (13) on the surface of the axis member (11) are within a range of 0.5 through 2.0 [mm] under an environment where ambient temperature is 10 through 32 [° C.]. Also, the difference in the linear expansion coefficient between the abutting rollers (12) and the discharging member (13) is $50\times10^{-5}$ [1/° C.] or less. Therefore, fluctuation of the charging gap due to change in temperature can be prevented effectively.

The linear expansion coefficient of the abutting rollers (12) and the linear expansion coefficient of the discharging member (13) are $50\times10^{-5}$ [1/° C.] or less. Therefore, fluctuation of the charging gap due to change in temperature can be prevented effectively.

Further, a value, which is obtained by subtracting the difference between the diameter of the abutting rollers (12) under an environment where ambient temperature is 30 [° C.] and the diameter of same under an environment where ambient temperature is 10 [° C.], from the difference between the diameter of the discharging member (13) under an environment where ambient temperature is 30 [° C.] and the diameter of same under an environment where ambient temperature is 10 [° C.], is 20 [μm]' or less. Therefore, it is possible to control fluctuation of the charging gap due to change in the diameters of the discharging member (13) and the abutting rollers (12) which is caused as the temperature fluctuates.

The linear expansion coefficient of the abutting rollers (12) is larger than the linear expansion coefficient of the discharging member (13). Therefore, when environmental temperature decreases, the decrease in the charging capability due to increase in the electrical resistance is offset by narrowing the charging gap, and a variation of the charging capability, which is caused by change in the electrical resistance of the discharging member (13) due to change in the temperature, can be controlled.

Moreover, the sum of the abutting lengths of the abutting rollers (12) with respect to the photoconductor (2) in the direction of the roller axis line is 6 through 18 [mm]. Therefore, while controlling decrease of the charging capability due to damage in the abutting sections of the abutting rollers on the photoconductor surface, enlargement of the device can be controlled.

Also, a surface friction coefficient of the abutting rollers (12) is 0.3 or less, thus fluctuation in the rotation speed caused by friction between the photoconductor (2) and the abutting rollers (12) causing friction with each other.

The pressure applied from the abutting rollers (12) to the photoconductor (2) is 0.05/g through 0.2/g [N/mm]. Therefore, while keeping the charging gap in a stable distance by securely causing the abutting rollers (12) to be welded to the photoconductor (2), a situation can be avoided in which smooth rotation of the photoconductor (2) or the charging roller (10) is disturbed by excessive abutting pressure.

Furthermore, the discharging member (13) having a multilayered structure is used, in which a base layer is covered with a surface layer made of a substance which is less adherent to the toner than the base layer. Therefore, toner adhesion to the discharging member (13) can be prevented.

Furthermore, a step of the discharging member (13) and abutting members (12) in the thickness directions under an environment where temperature is between 10 and 32 [° C.] is 40 through 60 [μm], and the straightness of the discharging member (13) in the direction of the axis line under the same environment is 20 [μm] or less. Therefore, the charging gap can be easily set within a range of 15 to 75 [μm].

Further, the abutting rollers (12) and the discharging member (13) are made of thermoplastic resins respectively, thus they can be molded easily.

Further, the abutting rollers (12) are made of an insulating resin, and the discharging member (13) is made of a conductive resin, thus the charging bias applied to the axis member (11) can be caused to conduct to the discharging member (13) to cause the discharging member (13) to generate a discharge therefrom, and at the same time increase in the surface potential of the abutting rollers (12) due to application of the charging bias is blocked, whereby toner adhesion onto the abutting rollers caused by the increase of the surface potential can be avoided.

Further, the electrical resistivity of the abutting rollers (12) is higher than $1\times10^9$ [Ωcm], the electrical resistivity of the discharging member (13) is lower than $1\times10^9$ [Ωcm], and a value obtained by dividing a value of the electrical resistivity of he abutting rollers (12) by a value of the electrical resistivity of the discharging member (13) is smaller than $1\times10^5$. Therefore, a good charging performance can be achieved with respect to the discharging member (13), and discharge from the abutting rollers (12) can be securely prevented.

Further, the abutting rollers (12) are fixed to the axis member (11) by means of resistance torques of at least 4/g [N/cm]. Therefore, when subjecting the fixed abutting rollers (12) to lathe turning and cutting, eccentric phase shift between the abutting rollers (12) and the discharging member (13) caused by the abutting rollers (12) slipping on the main axis portion (11*b*) can be avoided.

Furthermore, the photoconductor (2) in which the photosensitive layer (2*b*) is covered with the surface protection layer (2*e*). therefore, deterioration of the photosensitive layer due to the pressure of the abutting rollers (12) can be prevented.

As the photoconductor (2), using a photoconductor in which the photosensitive layer (2*b*) is covered not only in the latent image forming region in the direction of the axis line, but also in the non-latent image forming region in the same direction, the abutting rollers (12) are caused to abut onto the photosensitive layer (2*b*) in the non-latent image forming region. Therefore, compared to the case in which the photosensitive layer (2*b*) is not formed in the non-latent image forming region, the layer formation steps of the photoconductor (2) can be reduced and the production cost can be reduced. Furthermore, it is possible to avoid decrease in durability of the photoconductor (2) which is caused by generation of a connection line between the photosensitive layer (2*b*) in the latent image forming region and an insulating layer in the non-latent image forming region.

As the power source of the charging bias which is the bias supply means, the power source, which supplies a charging bias in which a AC bias is superimposed on an DC bias, is used, wherein the frequency [Hz] of the AC bias is more than seven times and less than twelve times a linear velocity [mm/sec] of the photoconductor (2). Therefore, charging irregularity in the form of a stripe caused when the frequency of the AC bias is too small can be avoided, and increase of abrasion wear or filming generation in the photoconductor caused when the frequency is too large can be avoided.

Various modifications will become possible for those skilled in the art after receiving the teachings of the present disclosure without departing from the scope thereof.

What is claimed is:

1. An image forming apparatus, comprising:

a latent image supporting body comprising a substrate and a covering layer provided on the substrate; and a charging device facing the latent image support body, the charging device being a rotating body comprising an axis member and a charging member provided on the axis member and that charges the latent image supporting body facing the charging member, wherein a value C1/L is at least 0.35 pF/mm, where C1 is a capacitance between the axis member in the rotating body and the substrate in the latent image supporting body when the substrate alone, without the covering layer, is caused to face the charging member, and where L is a length of the charging member along a direction of the axis member, wherein a charging gap of 15 μm- 75 μm is provided between the charging device and the latent image supporting body.

2. The image forming apparatus as claimed in claim 1, wherein the charging device further comprises abutting members fixed to the axis member throughout the entire circumference in the rotation direction of the axis member such that only the abutting members contact a surface of the latent image supporting body, thereby keeping a predetermined gap between the charging member and the latent image supporting body.

3. The image forming apparatus as claimed in claim 1, further comprising bias supply means for supplying a charging bias in which an AC bias is superimposed on a DC bias to the charging member of the charging device, wherein a frequency in Hz of the AC bias is more than seven times larger than a linear velocity in mm/sec of a surface migration of the latent image supporting body, and is less than twelve times larger than the linear velocity.

4. The image forming apparatus as claimed in claim 3, wherein the bias supply means subjects the AC bias to constant current control.

5. A process unit in which at least a latent image supporting body and a charging device of an image forming apparatus are detachably supported by the image forming apparatus main body as one unit, wherein the latent image supporting body comprises a substrate and a covering layer provided on the substrate, the charging device is a rotating body comprising an axis member and a charging member provided on the axis member, and charges the latent image supporting body facing the charging member, and a value C1/L is at least 0.35 pF/mm, where C1 is a capacitance between the axis member in the rotating body and the substrate in the latent image supporting body when the substrate alone, without the covering layer, is caused to face the charging member, and where Lisa length of the charging member along a direction of the axis member, wherein a charging gap of 15 μm- 75 μm is provided between the charging device and the latent image supporting body.

* * * * *